US009199491B2

(12) United States Patent
Takabatake et al.

(10) Patent No.: US 9,199,491 B2
(45) **Date of Patent: *Dec. 1, 2015**

(54) PRINTER WITH CUTTER HAVING ARM CONNECTING CENTER OF FIRST ROLLER AND CENTER OF SECOND ROLLER

(71) Applicant: FUJITSU COMPONENT LIMITED, Tokyo (JP)

(72) Inventors: Yoshinari Takabatake, Tokyo (JP); Sumio Watanabe, Tokyo (JP); Yukihiro Mori, Tokyo (JP); Masaru Kihara, Tokyo (JP); Masahiro Tsuchiya, Tokyo (JP); Toshio Yamaguchi, Tokyo (JP); Tetsuhiro Ishikawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/332,522

(22) Filed: Jul. 16, 2014

(65) Prior Publication Data

US 2014/0327204 A1 Nov. 6, 2014

Related U.S. Application Data

(63) Continuation of application No. PCT/JP2013/050993, filed on Jan. 18, 2013.

(30) Foreign Application Priority Data

Jan. 19, 2012 (JP) ..... 2012-009439

(51) Int. Cl.
*B41J 11/70* (2006.01)
*B41J 13/02* (2006.01)
(Continued)

(52) U.S. Cl.
CPC ..... *B41J 11/663* (2013.01); *B41J 3/4075* (2013.01); *B41J 11/70* (2013.01); *B41J 11/703* (2013.01); *B41J 13/009* (2013.01); *B41J 13/025* (2013.01); *B65C 9/0006* (2013.01); *B65C 2210/0078* (2013.01)

(58) Field of Classification Search
CPC ..... B41J 11/70; B41J 11/66; B41J 13/025; B41J 13/009; B65C 9/0006; B65C 2210/0078
See application file for complete search history.

(56) References Cited

U.S. PATENT DOCUMENTS 4,252,309 A 2/1981 Garrison et al.
5,031,893 A 7/1991 Yoneda et al.
(Continued)

FOREIGN PATENT DOCUMENTS

CN 1150931 6/1997
CN 101359376 2/2009
(Continued)

OTHER PUBLICATIONS

International Search Report mailed on Feb. 12, 2013.
(Continued)

*Primary Examiner* — Daniel J Colilla
(74) *Attorney, Agent, or Firm* — IPUSA, PLLC

(57) ABSTRACT

A printer includes a printing part that performs printing on a label adhering to a liner, a cutter that cuts the liner to which the label adheres, a first roller provided on the side to which the liner to which the label adheres is discharged from the cutter, a second roller that is in contact with the first roller and is rotated by the rotation of the first roller, a third roller that is in contact with the first roller and is rotated by the rotation of the first roller, and a connecting arm that connects the center of the first roller and the center of the second roller, wherein the liner is separated from the label by the first roller and the second roller, and the label separated from the liner is discharged by the third roller.

9 Claims, 23 Drawing Sheets

(51) Int. Cl.

| | |
|---|---|
| ***B41J 13/03*** | (2006.01) |
| ***B65C 9/00*** | (2006.01) |
| ***B41J 11/66*** | (2006.01) |
| ***B41J 3/407*** | (2006.01) |
| ***B41J 13/00*** | (2006.01) |

(56) References Cited

U.S. PATENT DOCUMENTS

| | | | | |
|---|---|---|---|---|
| 5,215,298 | A * | 6/1993 | Stemmle et al. | 271/65 |
| 5,478,428 | A * | 12/1995 | Carpenter | 156/719 |
| 5,588,762 | A | 12/1996 | Suzuki | |
| 5,931,458 | A * | 8/1999 | Morimoto | 271/186 |
| 6,371,481 | B1 | 4/2002 | Miyake | |
| 6,814,515 | B2 | 11/2004 | Tsuchiya et al. | |
| 6,966,966 | B2 * | 11/2005 | Koizumi et al. | 156/751 |
| 7,410,314 | B2 | 8/2008 | Thogersen et al. | |
| 7,857,534 | B2 | 12/2010 | Watanabe et al. | |
| 8,733,416 | B2 * | 5/2014 | Herard | 156/363 |
| 2009/0032193 | A1 | 2/2009 | Fukui et al. | |
| 2009/0190982 | A1 | 7/2009 | Yamamoto | |
| 2011/0211890 | A1 | 9/2011 | Shigeno et al. | |

FOREIGN PATENT DOCUMENTS

| | | |
|---|---|---|
| JP | H10-273260 | 10/1998 |
| JP | 2003-019845 | 1/2003 |
| JP | 2005-075628 | 3/2005 |
| JP | 2007-130842 | 5/2007 |
| JP | 2009-179414 | 8/2009 |
| JP | 2009-214431 | 9/2009 |
| JP | 2011-240997 | 12/2011 |

OTHER PUBLICATIONS

International Search Report mailed on Feb. 12, 2013 issued with respect to the related international application No. PCT/JP2013/050991.

U.S. Office Action mailed on Jul. 29, 2015 issued with respect to the related U.S. Appl. No. 14/332,532.

* cited by examiner

PRINTER WITH CUTTER HAVING ARM CONNECTING CENTER OF FIRST ROLLER AND CENTER OF SECOND ROLLER

CROSS-REFERENCE TO RELATED APPLICATIONS

The present application is a continuation application filed under 35 U.S.C. 111(a) claiming benefit under 35 U.S.C. 120 and 365(c) of PCT International Application No. PCT/JP2013/050993, filed on Jan. 18, 2013 and designating the U.S., which claims priority to Japanese Patent Application No. 2012-009439, filed on Jan. 19, 2012. The entire contents of all of the foregoing applications are incorporated herein by reference.

BACKGROUND OF THE INVENTION

1. Field of the Invention

The present invention relates to printers and methods of controlling a printer.

2. Description of the Related Art

Printers that output receipts are widely used for shop registers and automated teller machines (ATMs) or cash dispensers (CDs) in banks.

In such printers that output receipts, thermal paper serving as recording paper is wound in a roll, and printing is performed on the recording paper with a thermal head while conveying the recording paper. After conveying the recording paper a predetermined length, the recording paper is cut with a cutter to the predetermined length.

Some of these printers that output receipts include a presenter in order to prevent recording paper from being pulled out during printing or cutting with a cutter. The presenter is provided so that the recording paper subjected to printing enters the presenter to be cut and thereafter discharged from the presenter.

In addition to a function as a presenter, some presenters have a function as a retractor in order to prevent discharged recording paper, that is, a printed receipt or the like, that has been left behind, from being taken away by others.

Reference may be made to Japanese Laid-Open Patent Application No. 2003-19845 and Japanese Laid-Open Patent Application No. 2007-130842 for related art.

SUMMARY OF THE INVENTION

According to an aspect of the present invention, a printer includes a printing part that performs printing on a label adhering to a liner, a cutter that cuts the liner to which the label adheres, a first roller provided on the side to which the liner to which the label adheres is discharged from the cutter, a second roller that is in contact with the first roller and is rotated by the rotation of the first roller, a third roller that is in contact with the first roller and is rotated by the rotation of the first roller, and a connecting arm that connects the center of the first roller and the center of the second roller, wherein the liner is separated from the label by the first roller and the second roller, and the label separated from the liner is discharged by the third roller.

According to an aspect of the present invention, a method of controlling a printer includes holding a liner to which a label adheres between a first roller and a second roller by rotating the first roller in a first rotation direction and the second roller in a second rotation direction that is opposite to the first rotation direction, wherein the first roller is provided on a side to which the liner is discharged from a cutter that cuts the liner, the second roller is in contact with the first roller and is rotated by a rotation of the first roller, and a center of the second roller is connected to a center of the first roller by a connecting arm, moving the second roller in the second rotation direction on an outer periphery of the first roller with the liner to which the label adheres being held between the first roller and the second roller, by rotating the first roller in the second rotation direction, cutting the liner with the cutter, and separating the liner from the label by holding the liner between the first roller and the second roller, conveying the label from the second roller to a third roller that is in contact with the first roller and is rotated by the rotation of the first roller, and conveying the label in a direction to discharge the label with the third roller, by rotating the first roller in the first rotation direction.

DESCRIPTION OF THE EMBODIMENTS

Figure 1:
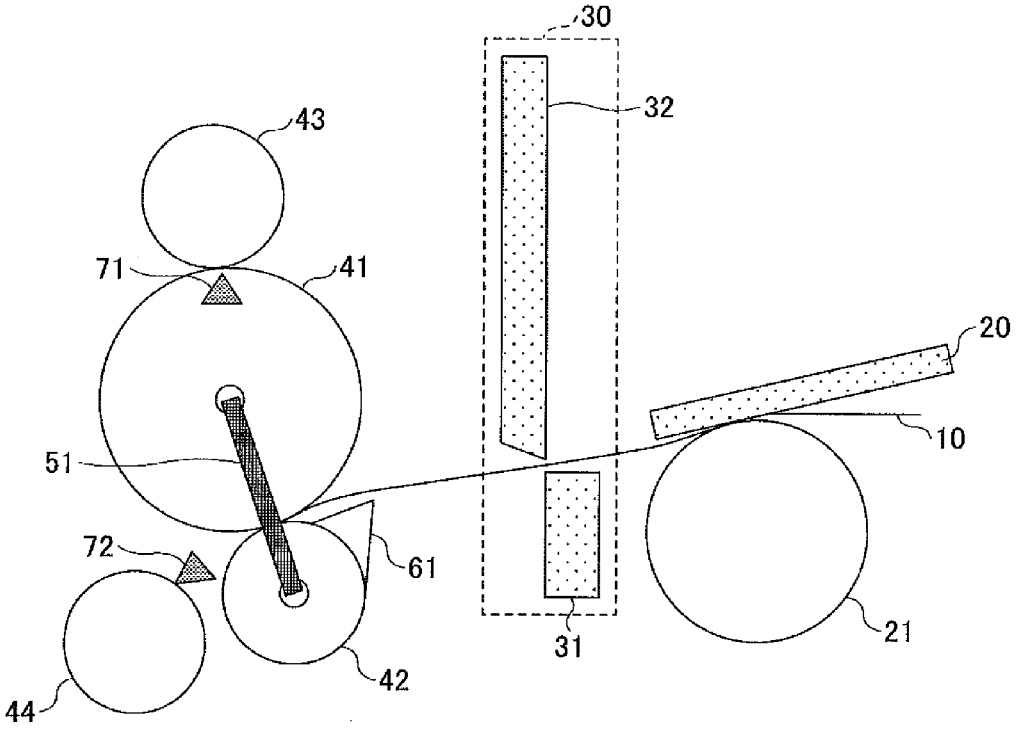
FIG. 1 is a structural diagram of a printer of a first embodiment.

Embodiments of the present invention are described below with reference to the accompanying drawings. The same members are referred to by the same reference numerals, and their description is omitted.

[First Embodiment]

[Printer Structure]

First, a printer structure of this embodiment is described based on FIG. 1. A printer of this embodiment includes a thermal head 20 that prints characters on recording paper 10 wound in a roll and a cutter part 30 that cuts the recording paper 10 subjected to printing in the thermal head 20 to a predetermined length. The recording paper 10 is thermal paper, and is subjected to printing by the thermal head 20 with the recording paper 10 being held between the thermal head 20 and a platen roller 21. The cutter part 30 includes a fixed blade 31 and a movable blade 32. The movable blade 32 moves relative to the fixed blade 31, so that it is possible to cut the recording paper 10 subjected to printing to a predetermined length.

In the printer of this embodiment, a first roller 41, a second roller 42, a third roller 43, and a fourth roller 44 for discharging the recording paper 10 subjected to printing are provided outside the cutter part 30. The first roller 41 may be rotated by a drive part that is not illustrated in the drawing. The second roller 42 is in contact with the first roller 41, and is rotated by the rotation of the first roller 41. The third roller 43 is in contact with the first roller 41, and is rotated by the rotation of the first roller 41. The center of the second roller 42 and the center of the first roller 41 are connected to one end and the other end of a connecting arm 51, respectively.

Furthermore, the second roller 42 is provided with a recording paper guide 61 in order to make it possible to smoothly guide the recording paper 10 to the second roller 42. Furthermore, sensors 71 and 72 for detecting the presence or absence of the recording paper 10 are provided at predetermined positions.

The printer of this embodiment implements functions as a presenter and a retractor with the first roller 41, the second roller 42, the third roller 43, the fourth roller 44, the connecting arm 51, the recording paper guide 61, and the sensors 71 and 72.

[Printer Operations]

Figure 2:
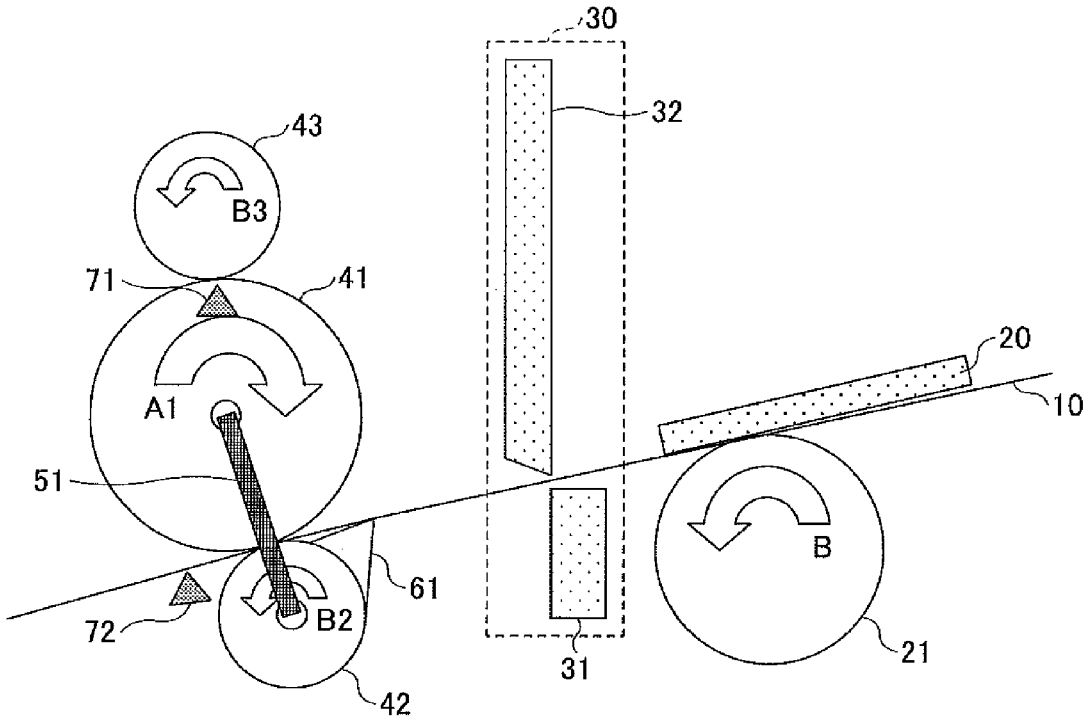
FIG. 2 is a diagram illustrating a method of discharging normal recording paper of a printer of the first embodiment.

Next, printer operations of this embodiment are described. First, the case of discharging the recording paper 10 without implementing a function as a presenter in a printer of this embodiment is described. In this case, as illustrated in FIG. 2, the recording paper 10 subjected to printing by the thermal head 20 is discharged through the cutter part 30 with the recording paper 10 being held between the first roller 41 and the second roller 42.

Specifically, when printing is performed on the recording paper 10 by the thermal head 20, the platen roller 21 rotates counterclockwise as indicated by arrow B, so that the recording paper 10 is conveyed through the cutter part 30 to the side on which the first roller 41 is provided. The second roller 42 is provided with the recording paper guide 61, and the recording paper 10 is conveyed along the recording paper guide 61 so as to enter between the first roller 41 and the second roller 42. That is, by rotating the first roller 41 clockwise as indicated by arrow A1, it is possible to rotate the second roller 42 counterclockwise as indicated by arrow B2. As a result, it is possible to hold the recording paper 10 between the first roller 41 and the second roller 42, and further to convey the recording paper 10 with the first roller 41 and the second roller 42 in a direction to discharge the recording paper 10. At this point, the third roller 43 is rotating counterclockwise as indicated by arrow B3. It is possible to detect with the sensor 72 whether the discharge of the recording paper 10 has started and whether the discharge of the recording paper 10 has ended. In this embodiment, one rotation direction may be described as a clockwise rotation direction, and the other rotation direction may be described as a counterclockwise rotation direction. The one rotation direction and the other rotation direction are rotation directions opposite to each other, either of which may be determined as the clockwise rotation direction. Furthermore, in FIG. 2, the fourth roller 44 is omitted.

Next, the case of discharging the recording paper 10 by causing a presenter to function in a printer of this embodiment is described based on FIGS. 3A through 3G. Unnecessary members in each process may be omitted in the drawings.

Figure 3A:
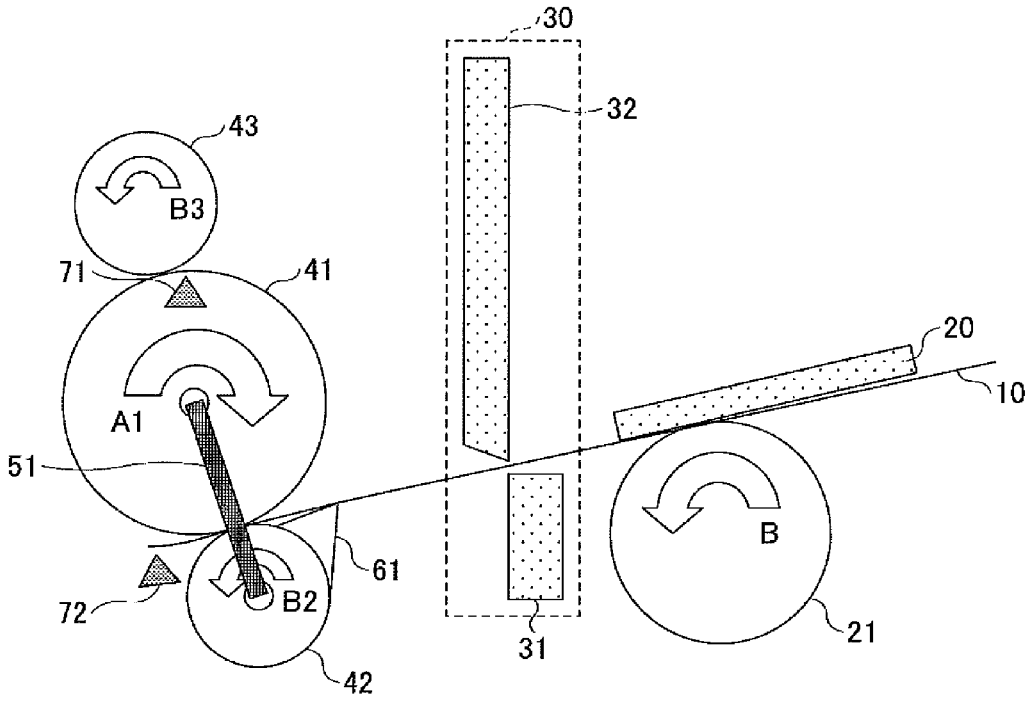
FIG. 3A is a diagram illustrating a presenter function of a printer of the first embodiment.

First, as illustrated in FIG. 3A, when printing is performed on the recording paper 10 by the thermal head 20, the platen roller 21 rotates counterclockwise as indicated by arrow B, so that the recording paper 10 is conveyed through the cutter part 30 to the side on which the first roller 41 is provided. The second roller 42 is provided with the recording paper guide 61, and the recording paper 10 is conveyed along the recording paper guide 61 so as to enter between the first roller 41 and the second roller 42. That is, by rotating the first roller 41 clockwise as indicated by arrow A1, the second roller 42 rotates counterclockwise as indicated by arrow B2, so that it is possible to hold the recording paper 10 between the first roller 41 and the second roller 42. At this point, the second roller 42 is rotating at the position illustrated in FIG. 3A by coming into contact with the fourth roller 44 not illustrated in the drawing or by the connecting arm 51 being formed so as to prevent its position from rotating clockwise from the state illustrated in FIG. 3A.

Figure 3B:
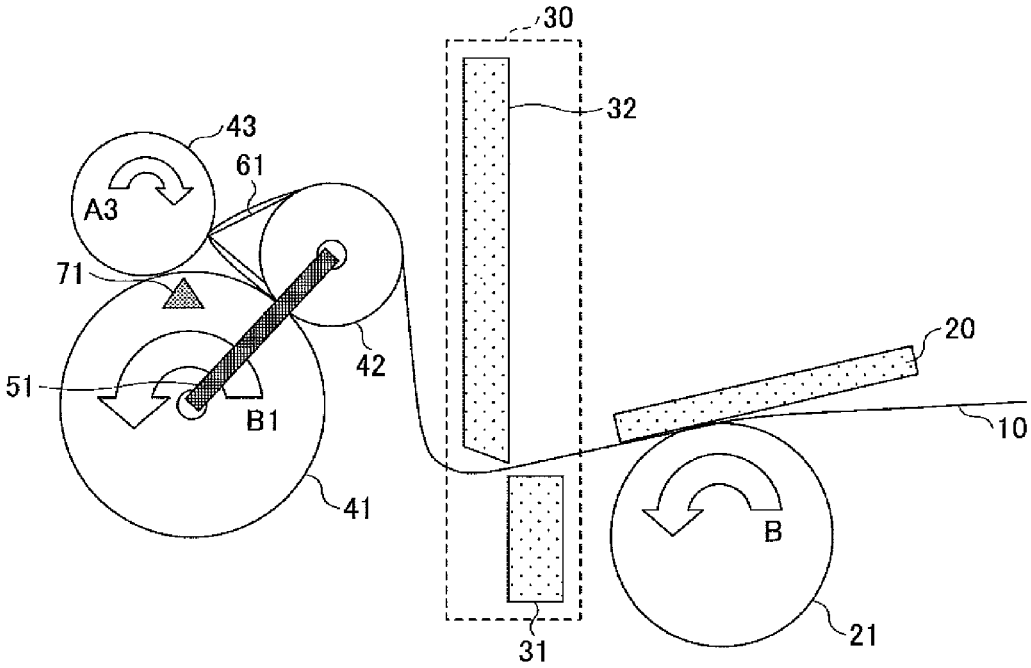
FIG. 3B is a diagram illustrating the presenter function of a printer of the first embodiment.

Next, as illustrated in FIG. 3B, the first roller 41 is rotated counterclockwise as indicated by arrow B1. As a result, the second roller 42, whose center is connected to the center of the first roller 41 by the connecting arm 51, moves counterclockwise on the outer periphery of the first roller 41 with an end portion of the recording paper 10 being held between the first roller 41 and the second roller 42. Specifically, the second roller 42 moves until the recording paper guide 61 provided on the second roller 42 comes into contact with the third roller 43 through the recording paper 10.

Figure 3C:
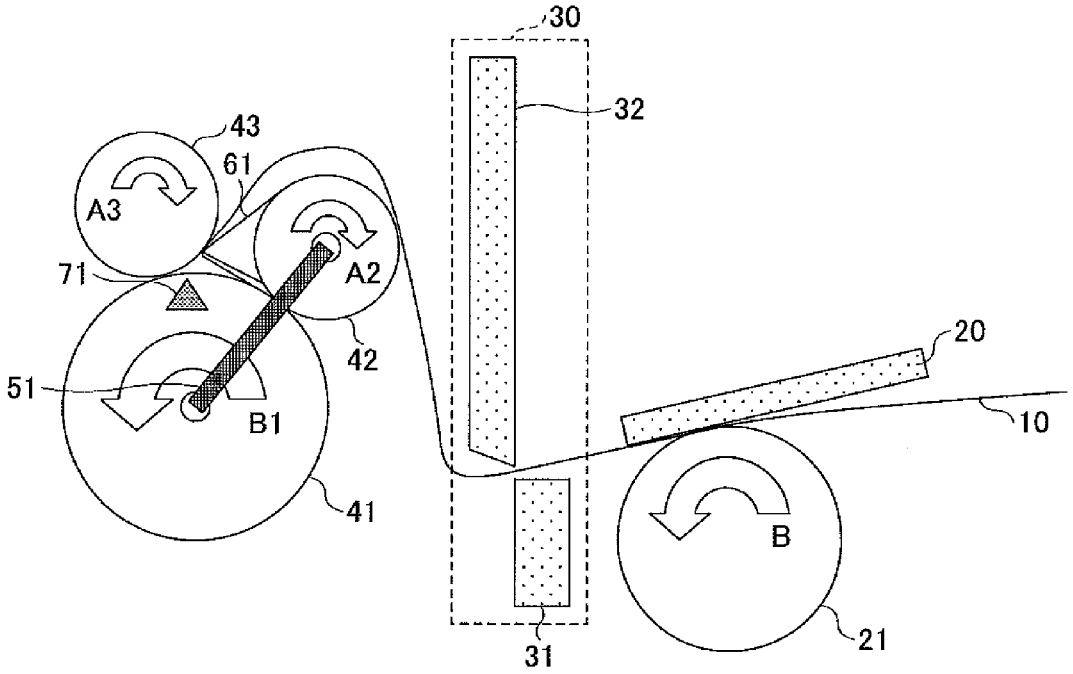
FIG. 3C is a diagram illustrating the presenter function of a printer of the first embodiment.

Next, as illustrated in FIG. 3C, the first roller 41 is rotated counterclockwise as indicated by arrow B1. By rotating the first roller 41 counterclockwise as indicated by arrow B1, the third roller 43 rotates clockwise as indicated by arrow A3, and as a result, the recording paper 10, which is brought into contact with the third roller 43 by the recording paper guide 61, is held between the first roller 41 and the third roller 43 by the rotation of the third roller 43. At this point, the second roller 42 is prevented from moving counterclockwise from the position illustrated in FIG. 3C, and therefore, the second roller 42 rotates clockwise as indicated by arrow A2 at the position illustrated in FIG. 3C.

Figure 3D:
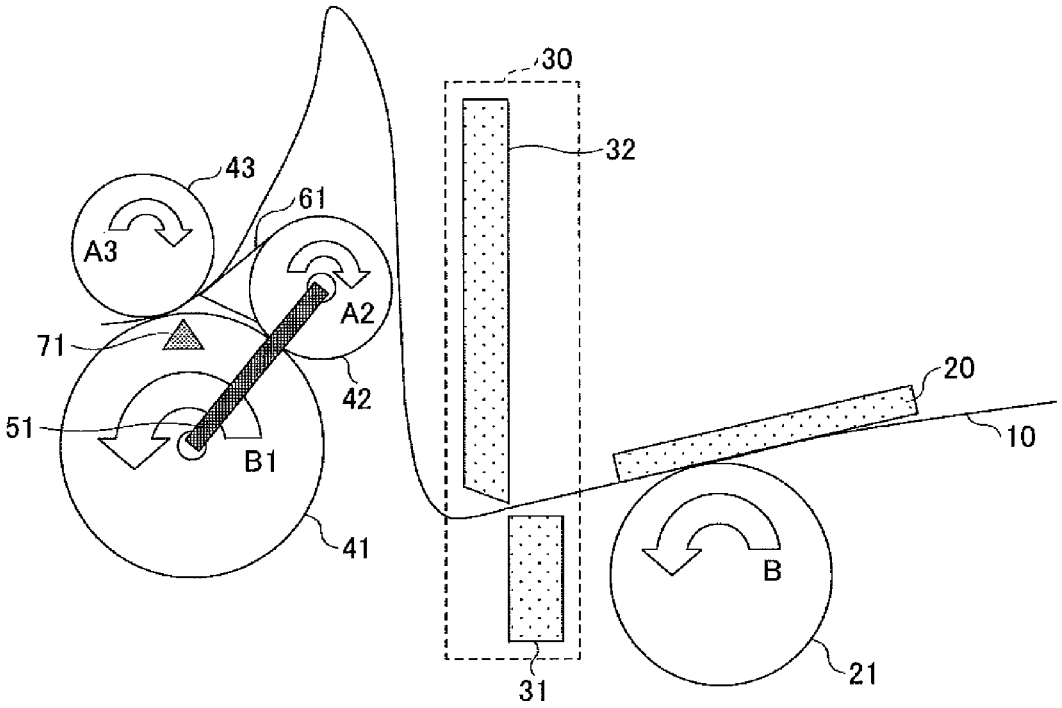
FIG. 3D is a diagram illustrating the presenter function of a printer of the first embodiment.

Next, as illustrated in FIG. 3D, printing continues to be performed on the recording paper 10 by the thermal printer 20. At this point, if the rotation of the first roller 41 is stopped, the recording paper 10 subjected to printing remains between the cutter part 30 and the first roller 41 because the platen roller 21 is rotating counterclockwise as indicated by arrow B. Furthermore, if the first roller 41 is rotated counterclockwise without being stopped, the recording paper 10 is conveyed in a direction to discharge the recording paper 10 by the first roller 41 and the third roller 43.

Figure 3E:
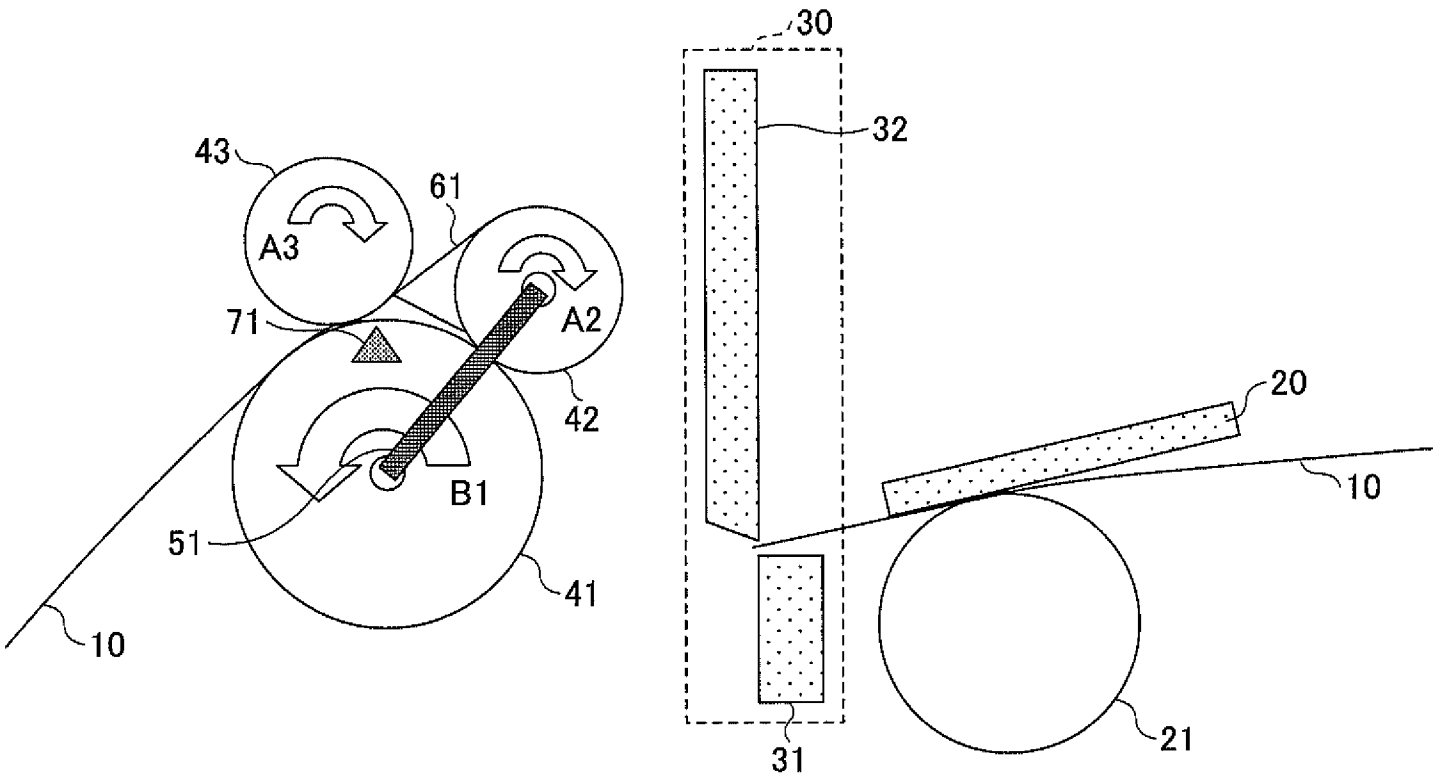
FIG. 3E is a diagram illustrating the presenter function of a printer of the first embodiment.

Next, as illustrated in FIG. 3E, after the completion of predetermined printing on the recording paper 10, the recording paper 10 is cut in the cutter part 30, and the recording paper 10 is conveyed up to a position where it is possible to remove the recording paper 10 by rotating the first roller 41 counterclockwise as indicated by arrow B1. In this state, the recording paper 10 subjected to printing is ready to be removed, and the rotation of the first roller 41 is stopped in order to maintain this state for a predetermined time. In this state, if the recording paper 10 subjected to printing is removed, the process of printing and discharging ends. On the other hand, if the recording paper 10 is not removed even after passage of the predetermined time, an operation to collect the recording paper 10 is performed.

Figure 3F:
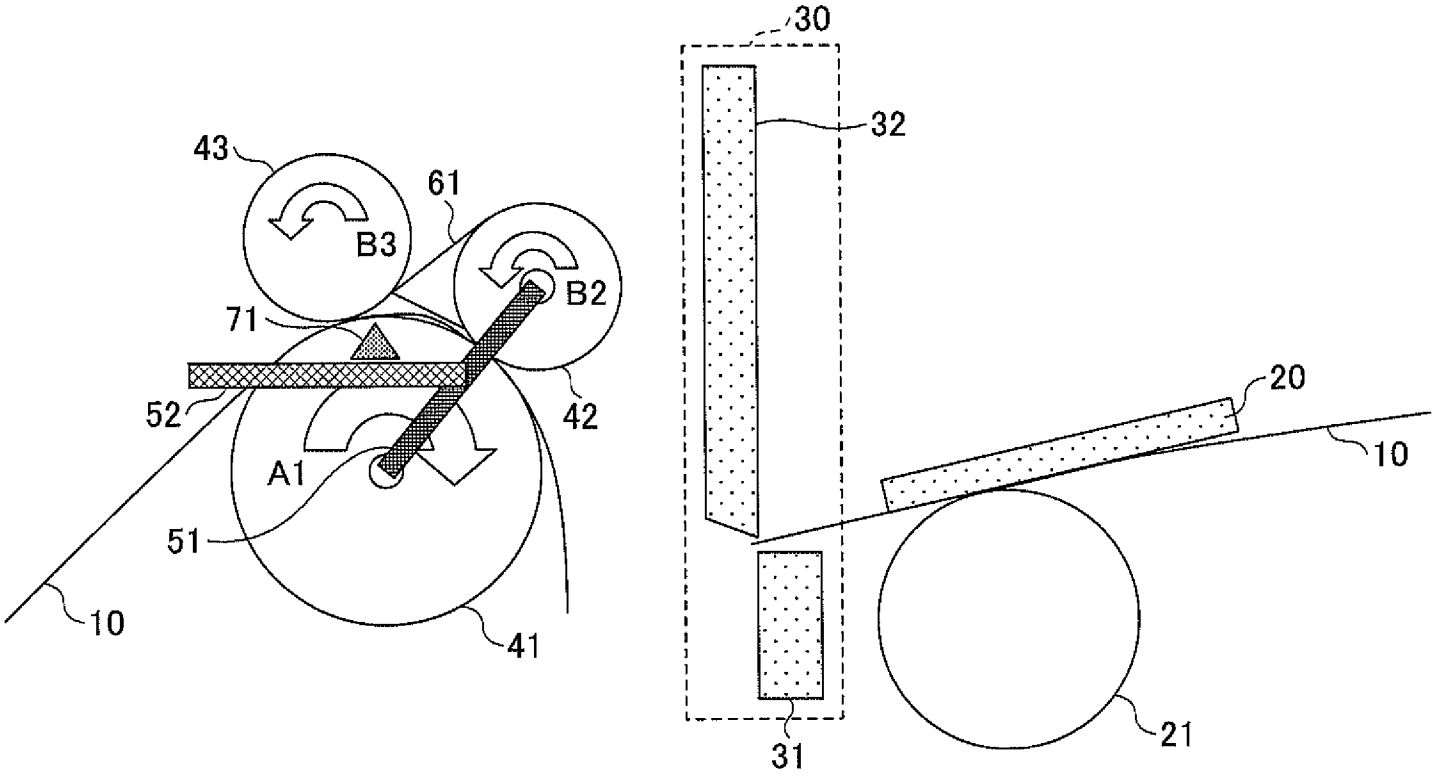
FIG. 3F is a diagram illustrating the presenter function of a printer of the first embodiment.

Specifically, as illustrated in FIG. 3F, the first roller 41 is rotated clockwise as indicated by arrow A1. At this point, the connecting arm 51 is locked at a predetermined position by a lock part 52, so that the position of the second roller 42 is fixed, and therefore, the second roller 42 rotates at this position. That is, by rotating the first roller 41 clockwise as indicated by arrow A1, the second roller 42 rotates counterclockwise as indicated by arrow B2, and the recording paper 10 subjected to printing held between the first roller 41 and the third roller 43 is conveyed by the first roller 41 and the third roller 43 to be held between the first roller 41 and the second roller 42. The connecting arm 51 continues to be lacked at the predetermined position by the lock part 52 until the recording paper 10 is held between the first roller 41 and the second roller 42. Thereafter, by releasing the connecting arm 51 locked by the lock part 52, the second roller 42 whose center is connected to the center of the first roller 41 by the connecting arm 51 moves clockwise on the outer periphery of the first roller 41 because the first roller 41 is rotating clockwise as indicated by arrow A1. The measure for locking the connecting arm 51 at the above-described predetermined position is not limited to the lock part 52, and may be any measure having a similar function, for example, any measure having a mechanism capable of fixing the second roller 42 at a predetermined position and rotating the second roller 42 at the position at which the second roller 42 is fixed.

Figure 3G:
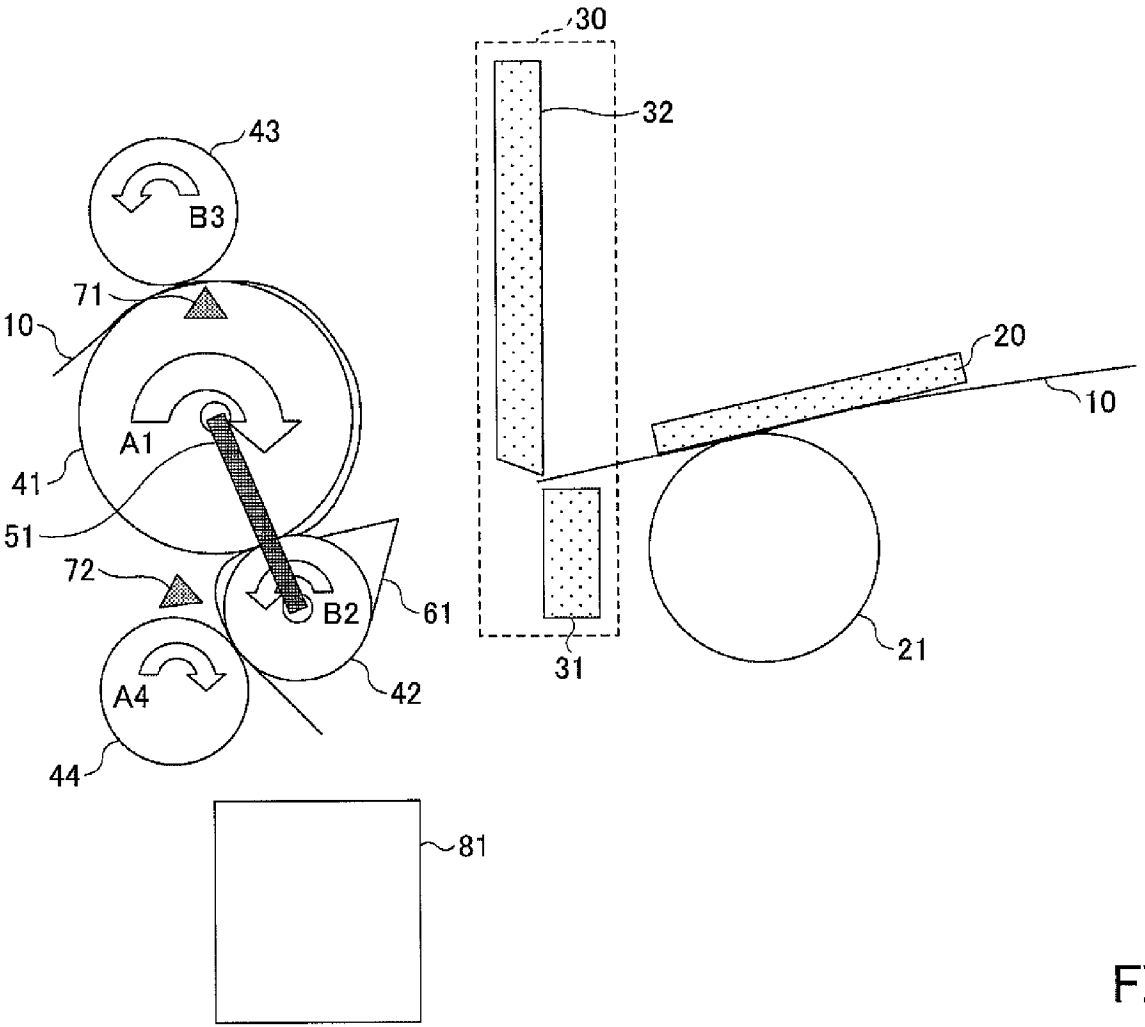
FIG. 3G is a diagram illustrating the presenter function of a printer of the first embodiment.

Next, as illustrated in FIG. 3G, by further rotating the first roller 41 clockwise as indicated by arrow A1 from the state illustrated in FIG. 3F, the second roller 42 is moved to a position where the second roller 42 comes into contact with the fourth roller 44. In this state, because the first roller 41 is rotating clockwise as indicated by arrow A1, the second roller 42 is rotating counterclockwise as indicated by arrow B2. Furthermore, the fourth roller 44 is a roller that rotates by contacting the second roller 42, and as a result of the second roller 42 rotating counterclockwise as indicated by arrow B2, the fourth roller 44 rotates clockwise as indicated by arrow A4, so that the recording paper 10 is held between the second roller 42 and the fourth roller 44. Thereafter, the recording paper 10 held between the second roller 42 and the fourth roller 44 is conveyed to and collected into a retractor box 81 by the counterclockwise rotation of the second roller 42 as indicated by arrow B2 and the clockwise rotation of the fourth roller 44 as indicated by arrow A4.

Figure 4A:
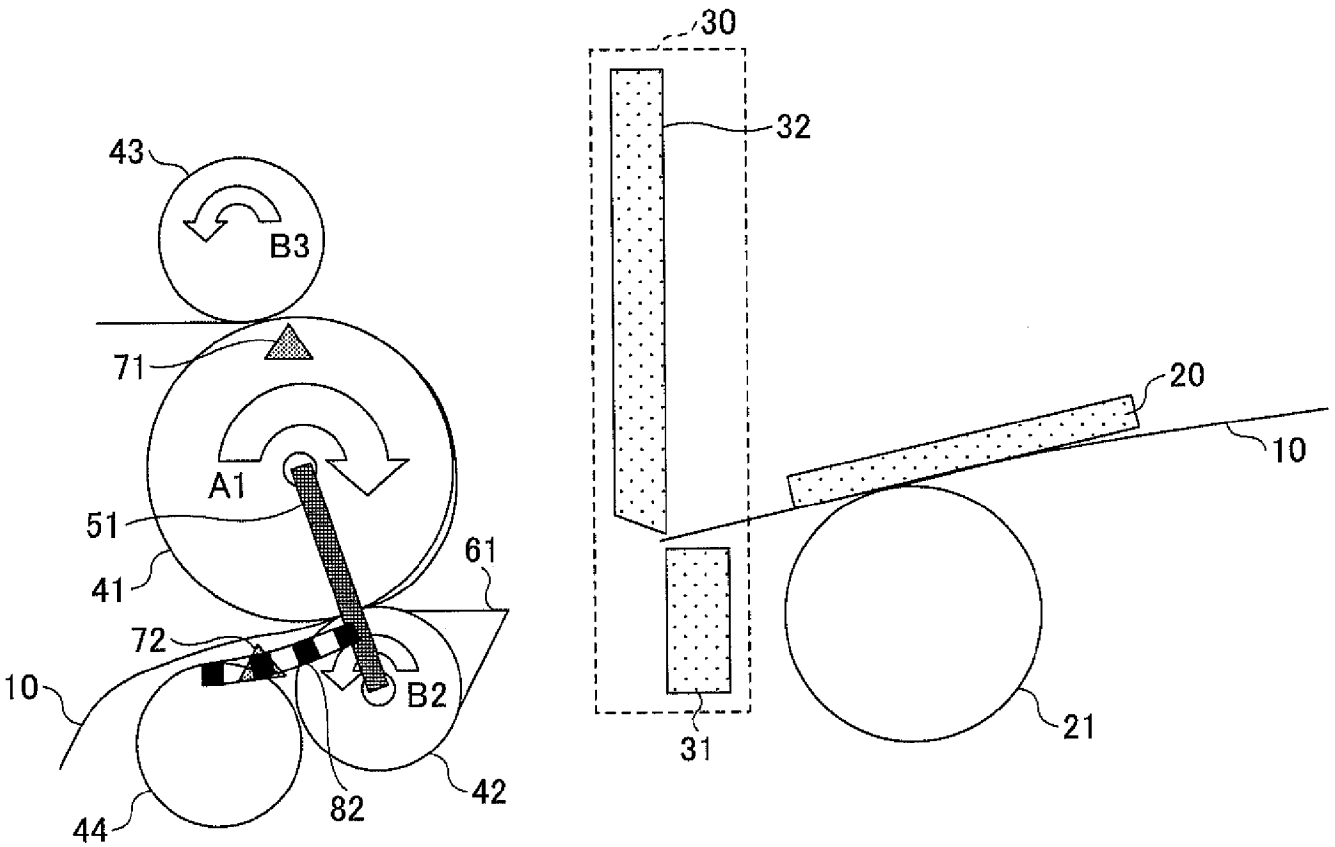
FIG. 4A is a diagram illustrating a recording paper switching guide of a printer of the first embodiment.
Figure 4B:
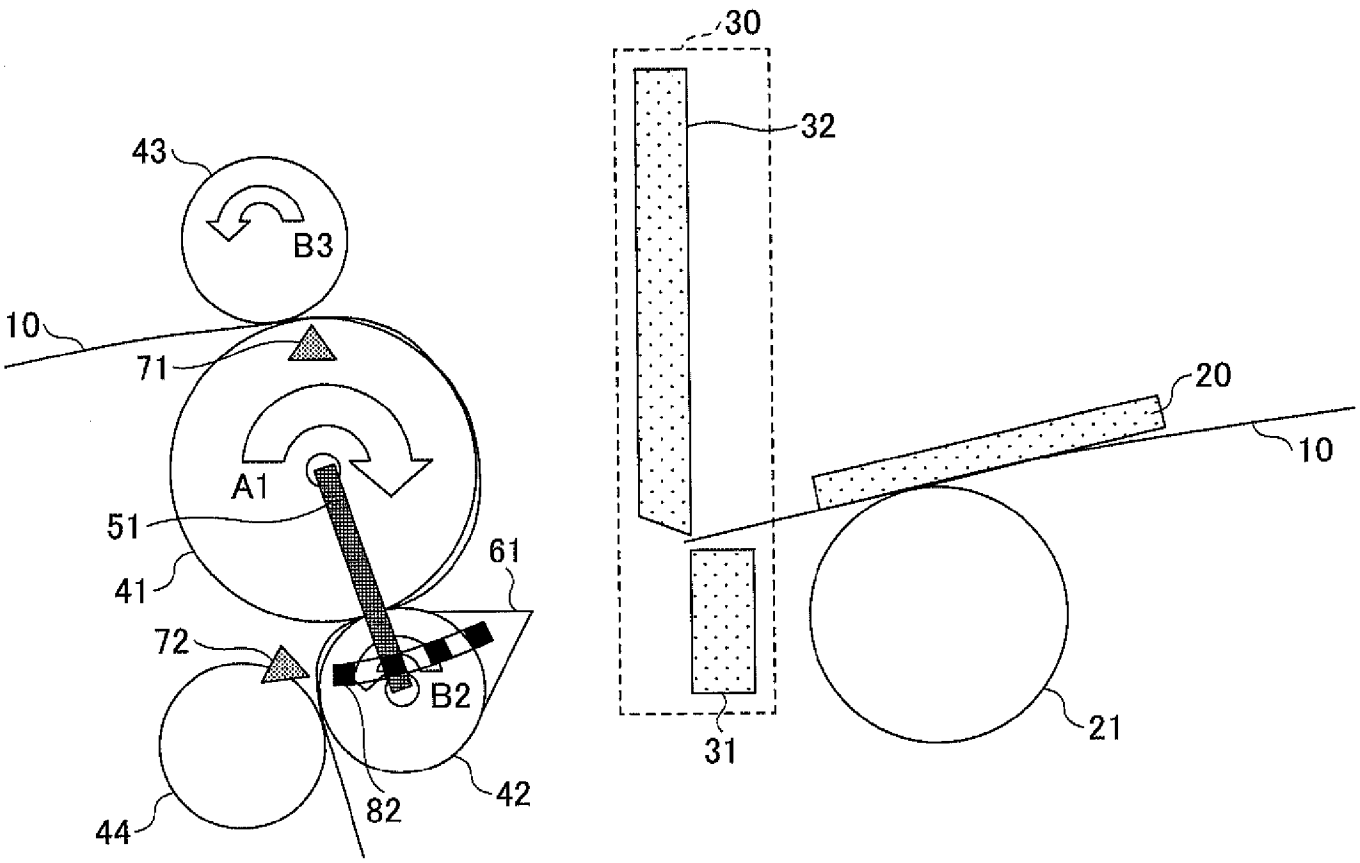
FIG. 4B is a diagram illustrating the recording paper switching guide of a printer of the first embodiment.

The printer of this embodiment may be provided with a recording paper switching guide 82 capable of changing the discharge direction of the recording paper 10 as illustrated in FIGS. 4A and 4B. Specifically, with the recording paper switching guide 82 being moved to a position over (an entrance opening between) the second roller 42 and the fourth roller 44 as illustrated in FIG. 4A, it is possible to discharge the recording paper 10 between the first roller 41 and the second roller 42 and between the first roller 41 and the fourth roller 44. Furthermore, with the recording paper switching guide 82 being moved from the position illustrated in FIG. 4A to the side on which the cutter part 30 is provided as illustrated in FIG. 4B, it is possible to discharge the recording paper 10 between the first roller 41 and the second roller 42 and between the second roller 42 and the fourth roller 44. By thus moving the position of the recording paper switching guide 82, it is possible to select a direction to discharge the collected recording paper 10.

The printer of this embodiment implements functions as a presenter and a retractor with the first roller 41, the second roller 42, the third roller 43, and the fourth roller 44. Therefore, it is possible to reduce the size of a printer having a presenter function.

[Second Embodiment]

Next, a second embodiment is described. This embodiment relates to a method of controlling a printer of the first embodiment. In order to describe a method of controlling a printer of this embodiment, a structure of a printer of this embodiment is described based on FIG. 5. This printer includes a first sensor S1 and a second sensor S2 that detect the presence or absence of entry of the recording paper 10 from the cutter part 30. The first sensor S1 is a reflective sensor, and the second sensor S2 is a sensor that detects transmitted light. It is possible to determine the conditions of the recording paper 10 such as the presence or absence of the recording paper 10 and the paper quality of the recording paper 10 with the first sensor S1 and the second sensor S2. Furthermore, the printer includes a third sensor S3 for detecting whether the recording paper 10 is discharged from a first discharge opening 301, a fourth sensor S4 for detecting whether the recording paper 10 is discharged from a second discharge opening 302, a fifth sensor S5 for detecting whether the recording paper 10 is discharged from a third discharge opening 303, and a sixth sensor S6 for detecting whether the recording paper 10 is retracted. Furthermore, the printer includes a seventh sensor S7 and an eighth sensor S8 for detecting the position of the connecting arm 51 connecting the first roller 41 and the second roller 42. The fourth sensor S4 of this embodiment corresponds to the sensor 71 of the first embodiment, and the third sensor S3 of this embodiment corresponds to the sensor 72 of the first embodiment. Furthermore, the printer is provided with a fifth roller 45 that rotates by contacting the third roller 43 in addition to the first roller 41, the second roller 42, the third roller 43, and the fourth roller 44.

Figure 5:
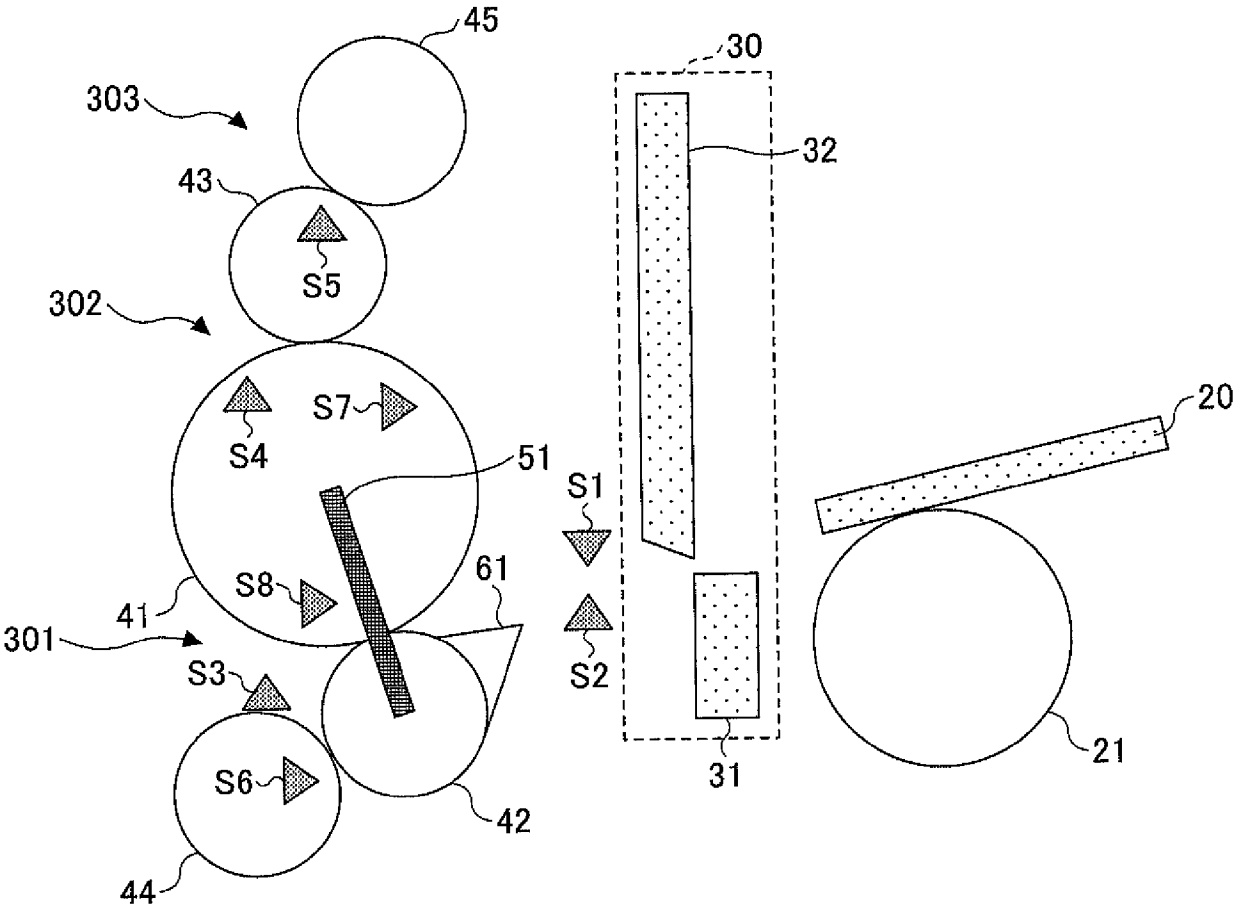
FIG. 5 is a diagram illustrating a printer of a second embodiment.
Figure 6A:
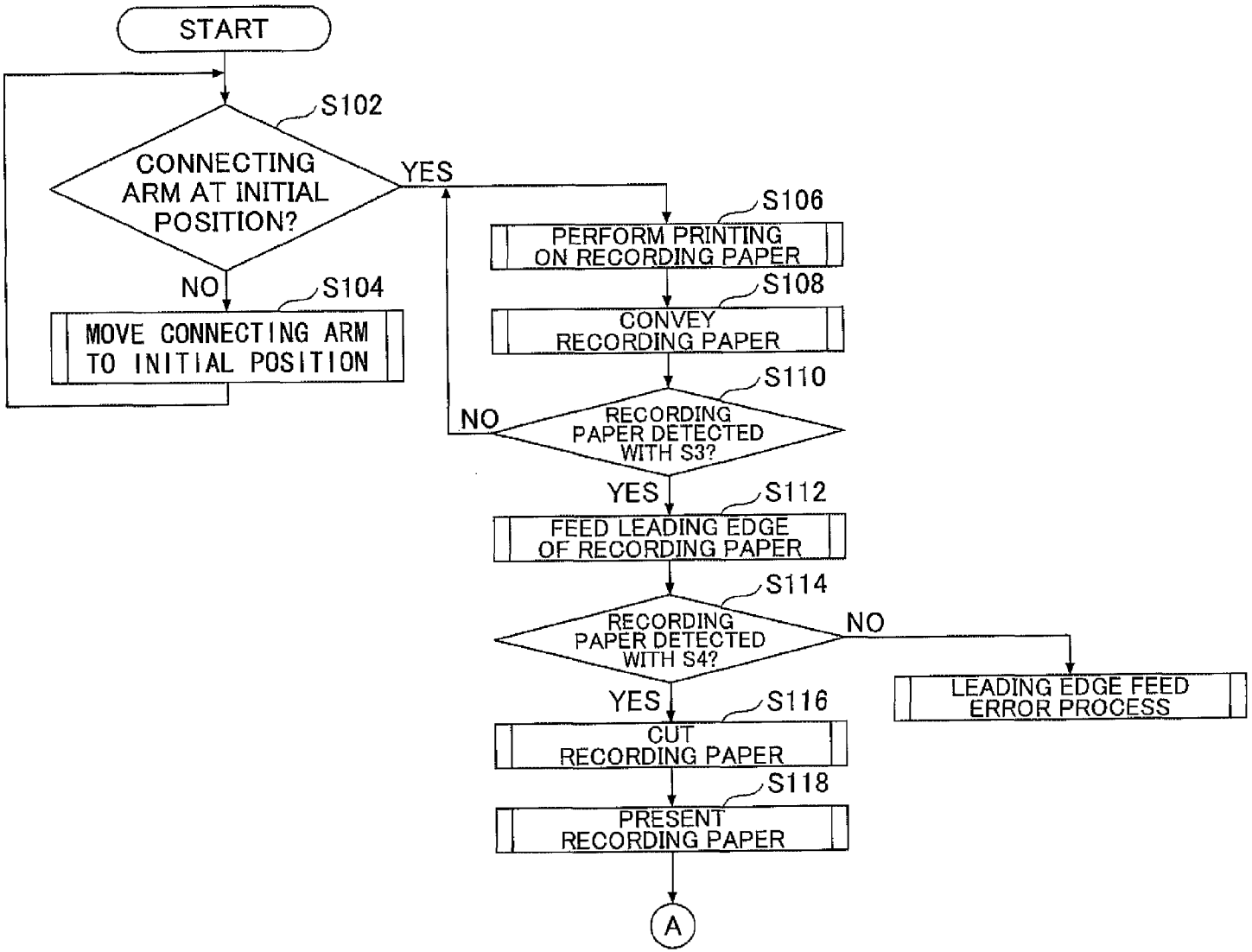
FIG. 6A is a flowchart of a method of controlling a printer of the second embodiment.
Figure 6B:
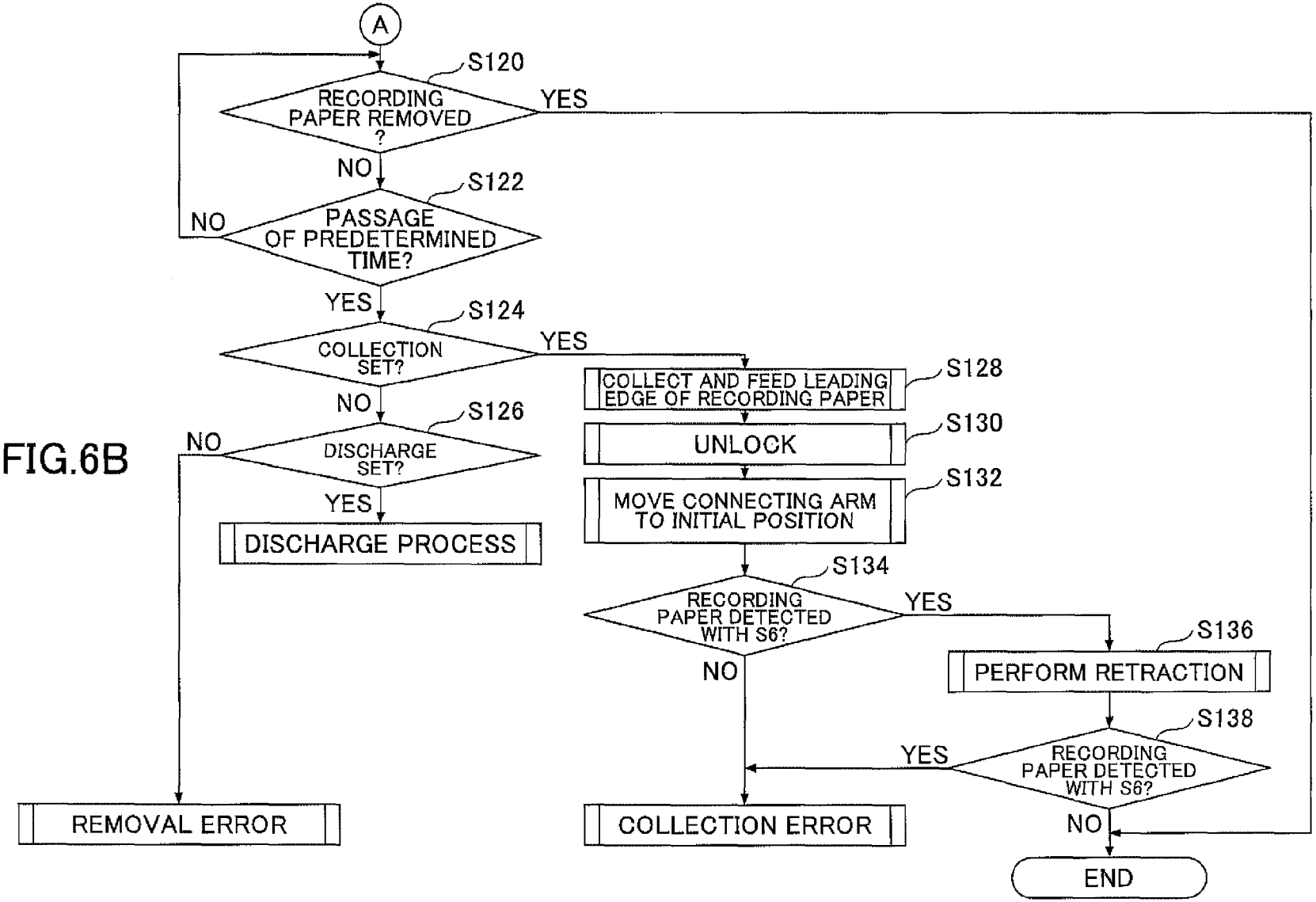
FIG. 6B is a flowchart of the method of controlling a printer of the second embodiment.

A method of controlling a printer of this embodiment is described based on FIGS. 6A and 6B. This method of controlling a printer is a control method when operating the printer as a presenter of the recording paper 10 at the second discharge opening 302. When the printer is not operated as a presenter, the recording paper 10 is discharged from the first discharge opening 301 illustrated in FIG. 5 the same as in the case illustrated in FIG. 2 in the first embodiment.

First, at step S102 of FIG. 6A, it is determined whether the connecting arm 51 is at a predetermined initial position. The connecting arm 51 is referred to as being at a predetermined initial position when, for example, the connecting arm 51 is positioned so as to cause the second roller 42 to be below the first roller 41 as illustrated in FIG. 5. Whether the connecting arm 51 is at an initial position may be determined by whether the eighth sensor S8 detects the connecting arm 51 or not. If the connecting arm 51 is detected by the eighth sensor S8 so that it is determined that the connecting arm 51 is at an initial position (YES at step S102), the process proceeds to step S106. On the other hand, if the connecting arm 51 is not detected by the eighth sensor S8 so that it is determined that the connecting arm 51 is not at an initial position (NO at step S102), the process proceeds to step S104.

Next, at step S104, the connecting arm 51 is moved to the predetermined initial position, that is, a position where the connecting arm 51 is detected by the eighth sensor S8. Specifically, the connecting arm 51 is moved to the predetermined initial position by moving the second roller 42 in contact with the outer periphery of the first roller 41 clockwise by rotating the first roller 41 clockwise. If the connecting arm 51 is not detected by the eighth sensor S8 even after repeating this process several times, an error process is executed.

On the other hand, at step S106, printing is performed on the recording paper 10. At this point, because the platen roller 21 rotates counterclockwise, the recording paper 10 is conveyed through the cutter part 30 to the side on which the first roller 41 that operates as a presenter is provided.

Next, at step S108, the recording paper 10 is conveyed while performing a predetermined amount of printing on the recording paper 10, and further, the first roller 41 is rotated clockwise. Because the platen roller 21 rotates counterclockwise, the recording paper 10 subjected to printing is conveyed, so that the recording paper 10 is held between the first roller 41 rotating clockwise and the second roller 42 rotating counterclockwise.

Next, at step S110, the presence or absence of the recording paper 10 is determined by the third sensor S3. If the recording paper 10 is detected by the third sensor S3 (sensor 72) as illustrated in FIG. 3A (YES at step S110), the process proceeds to step S112. On the other hand, if the recording paper 10 is not detected by the third sensor S3 (NO at step S110), the process proceeds to step S106.

Figure 7:
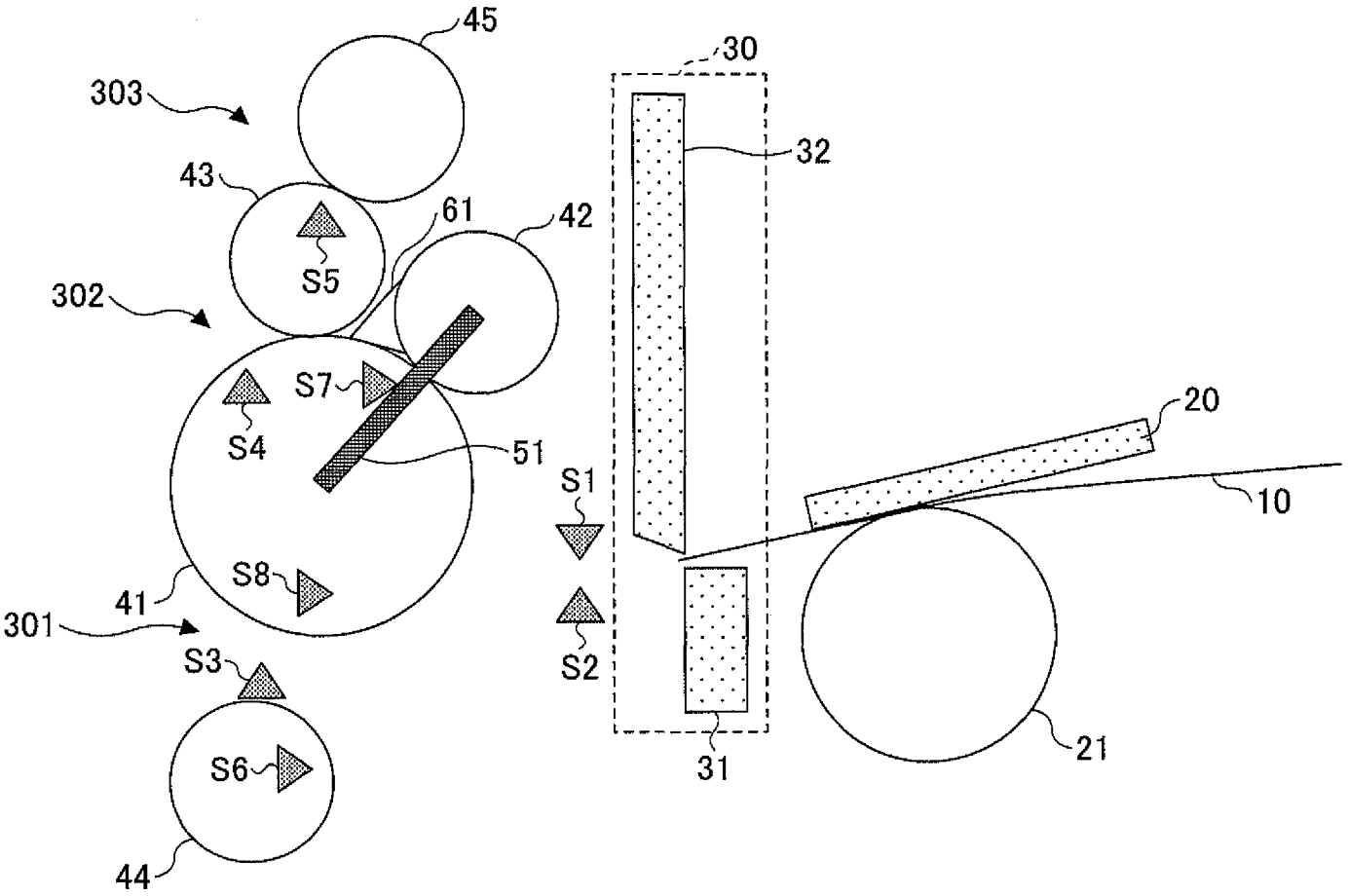
FIG. 7 is a diagram illustrating a printer of the second embodiment.

Next, at step S112, an operation to feed a leading edge of the recording paper 10 is performed. That is, by rotating the first roller 41 counterclockwise, the second roller 42 is moved counterclockwise on the outer periphery of the first roller 41. At this point, the second roller 42 moves on the outer periphery of the first roller 41 with the recording paper 10 being held between the first roller 41 and the second roller 42. As illustrated in FIG. 7, the second roller 42 moves until the second roller 42 is positioned above the first roller 41, and with this, the connecting arm 51 also moves. The position of the connecting arm 51 in this state can be detected with the seventh sensor S7. By rotating the first roller 41 counterclockwise in the state illustrated in FIG. 7, the third roller 43 rotates clockwise. As a result, it is possible to hold the recording paper 10 between the first roller 41 and the third roller 43. In this state, the thermal head 20 continues to perform printing on the recording paper 10. Specifically, it is possible to cause a transition from the state illustrated in FIG. 3B to the state illustrated in FIG. 30.

Next, at step S114, the presence or absence of the recording paper 10 is determined by the fourth sensor S4. If the recording paper 10 is detected by the fourth sensor S4 (YES at step S114), the process proceeds to step S116. On the other hand, if the recording paper 10 is not detected by the fourth sensor S4 (NO at step S114), it is determined as a leading edge feed error, and a leading edge feed error process is executed.

Next, at step S116, printing on the recording paper 10 by the thermal head 20 is stopped, and the recording paper 10 is cut to a predetermined length in the cutter part 30. Specifically, the recording paper 10 is cut to a predetermined length after the recording paper enters the state illustrated in FIG. 3D.

Next, at step S118, the recording paper 10 is presented. Specifically, the recording paper 10 subjected to printing is conveyed to a predetermined position at the second discharge opening 302 with the first roller 41 and the third roller 43 by rotating the third roller 43 clockwise by rotating the first roller 41 counterclockwise. Specifically, the recording paper 10 is conveyed to the predetermined position as illustrated in FIG. 3E.

Next, at step S120 of FIG. 6B, it is determined whether the recording paper 10 subjected to printing at the second discharge opening 302 is removed. If the recording paper 10 is removed (YES at step S120), the process of FIG. 6B ends. On the other hand, if the recording paper 10 is not removed (NO at step S120), the process proceeds to step S122. Whether the recording paper 10 is removed may be determined by whether the recording paper 10 is detected at the fourth sensor S4.

Next, at step S122, it is determined whether a predetermined time has passed. If it is determined that a predetermined time has passed (YES at step S122), the process proceeds to step S124. On the other hand, if it is determined that a predetermined time has not passed (NO at step S122), the process proceeds to step S120.

Next, at step S124, it is determined whether a collection of the recording paper 10 is set or not. Specifically, it is determined whether a flag indicating that the recording paper 10 subjected to printing is to be collected if the recording paper 10 is not removed within a predetermined time is set or not at initial settings. If a flag indicating that the recording paper 10 subjected to printing is to be collected is on (YES at step S124), it is determined that the collection of the recording paper 10 is set, and the process proceeds to step S128. On the other hand, if no flag to the effect that the recording paper 10 subjected to printing is to be collected is on (NO at step S124), it is determined that the collection of the recording paper 10 is not set, and the process proceeds to step S126.

Next, at step S126, it is determined whether a discharge of the recording paper 10 is set. Specifically, it is determined whether a flag indicating that the recording paper 10 subjected to printing is to be discharged if the recording paper 10 is not removed within a predetermined time is set or not at the initial settings. If a flag indicating that the recording paper 10 subjected to printing is to be discharged is on (YES at step S126), it is determined that the discharge of the recording paper 10 is set, and a discharge process to discharge the recording paper 10 subjected to printing is executed. On the other hand, if no flag indicating that the recording paper 10 subjected to printing is to be discharged is on (NO at step S126), it is determined that the discharge of the recording paper 10 is not set, thus resulting in a removal error, so that an error display is performed.

On the other hand, at step S128, the first roller 41 is rotated clockwise from the state illustrated in FIG. 3E where the connecting arm 51 is locked. By thus rotating the first roller 41 clockwise with the connecting arm 51 being locked, the second roller 42 rotates counterclockwise, so that it is possible to cause the recording paper 10 held between the first roller 41 and the third roller 43 to be held between the first roller 41 and the second roller 42. Specifically, the recording paper 10 can be held between the first roller 41 and the second roller 42 as illustrated in FIG. 3F. The state where the connecting arm 51 is thus locked by the lock part 52 is maintained until the recording paper 10 held between the first roller 41 and the third roller 43 is held between the first roller 41 and the second roller 42.

Next, at step S130, the connecting arm 51 is unlocked. As a result, the connecting arm 51 can move, so that the second roller 42 can move on the outer periphery of the first roller 41.

Next, at step S132, an operation to move the connecting arm 51 to a predetermined position is performed. That is, by rotating the first roller 41 clockwise, the second roller 42 is moved clockwise on the outer periphery of the first roller 41. At this point, the second roller 42 moves clockwise on the outer periphery of the first roller 41 with the recording paper 10 being held between the first roller 41 and the second roller 42. As a result, it is possible to move the second roller 42 to a predetermined initial position. It is possible to detect the position of the connecting arm 51 after the movement with the eighth sensor S8. Specifically, the second roller 42 is moved to the predetermined initial position as illustrated in FIG. 3G. At this point, the second roller 42 is in contact with the fourth roller 44.

Next, at step S134, it is determined whether the recording paper 10 is detected at the sixth sensor S6. If the recording paper 10 is detected by the sixth sensor S6 (YES at step S134), it is possible to perform a retracting operation, so that the process proceeds to step S136. On the other hand, if the recording paper 10 is not detected by the sixth sensor S6 (NO at step S134), it is determined as a collection error, and an error display is performed.

Next, at step S136, retraction is performed. That is, as illustrated in FIG. 3G, with a clockwise rotation of the first roller 41, the second roller 42 rotates counterclockwise and the fourth roller 44 rotates clockwise, so that the recording paper 10 subjected to printing is held between the second roller 42 and the fourth roller 44, and the recording paper 10 is thereafter conveyed to the retractor box 81 from between the first roller 41 and the second roller 42 through the second roller 42 and the fourth roller 44. At this point, the recording paper 10 is detected by the sixth sensor S6.

Next, at step S138, it is determined whether the retracting operation has ended. Specifically, if the sixth sensor S6 continues to detect the recording paper 10 (YES at step S138), it is determined as a collection error, and an error display is performed. On the other hand, if the recording paper 10 is no longer detected by the sixth sensor S6 (NO at step S138), it is determined that the retracting operation has normally ended, and the method of controlling a printer according this embodiment ends.

[Third Embodiment]

Next, a third embodiment is described. A printer according to this embodiment is the same printer as in the first embodiment, and performs printing on a label with an adhesive substance such as glue adhering to its bottom surface. Printing is performed on such a label with the label being applied to a liner because of adhesion of an adhesive substance such as glue to the bottom surface of the label. According to the printer of this embodiment, it is possible to switch between printing on normal recording paper and printing on a label using a switch provided in the printer. Furthermore, the printer of this embodiment is provided with an assist roller 143 that rotates in contact with the third roller 43.

The case of discharging a label 110 subjected to printing in the printer of this embodiment is described based on FIGS. 8A through 8G. In the initial state, the label 110 is applied to a liner 111.

Figure 8A:
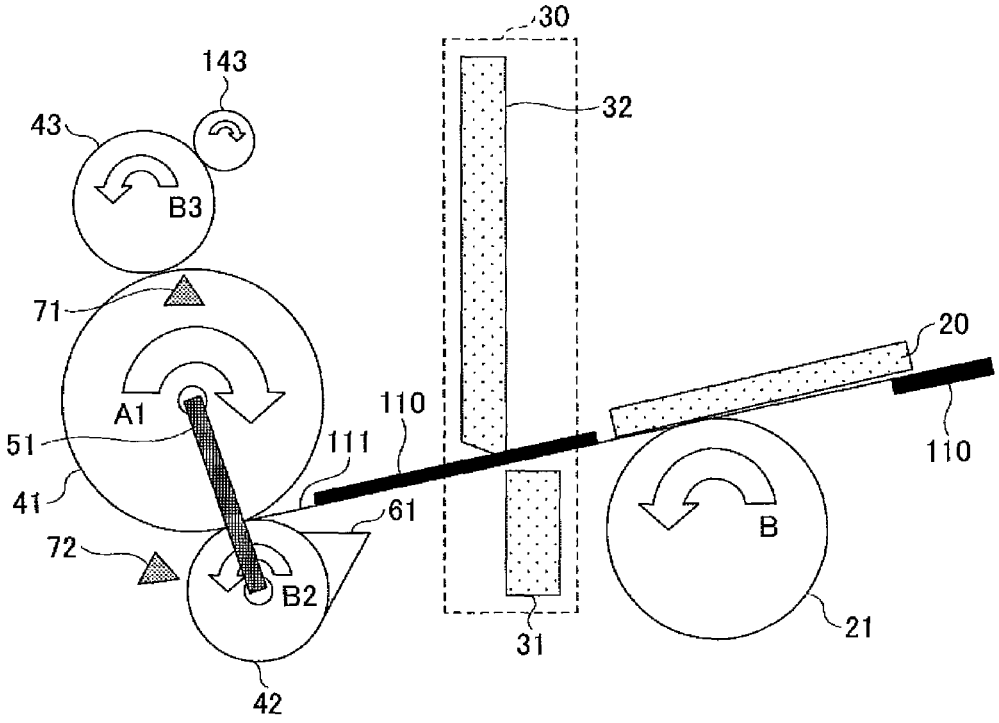
FIG. 8A is a diagram illustrating a method of discharging a label of a printer of a third embodiment.

First, as illustrated in FIG. 8A, printing is performed on the label 110 applied to the liner 111 by the thermal head 20. At this point, the platen roller 21 rotates counterclockwise as indicated by arrow B, so that the liner 111 to which the label 110 is applied is conveyed through the cutter part 30 to the side on which the first roller 41 is provided. The second roller 42 is provided with the recording paper guide 61, and the liner 111 to which the label 110 is applied is conveyed along the recording paper guide 61 so as to enter between the first roller 41 and the second roller 42. That is, by rotating the first roller 41 clockwise as indicated by arrow A1, the second roller 42 rotates counterclockwise as indicated by arrow B2, so that it is possible to hold an end portion of the liner 111 to which the label 110 is applied by the first roller 41 and the second roller 42. At this point, the second roller 42 is rotating at the position illustrated in FIG. 8A by coming into contact with the fourth roller 44 not illustrated in the drawing or by the connecting arm 51 being formed so as to prevent its position from rotating clockwise from the state illustrated in FIG. 8A.

Figure 8B:
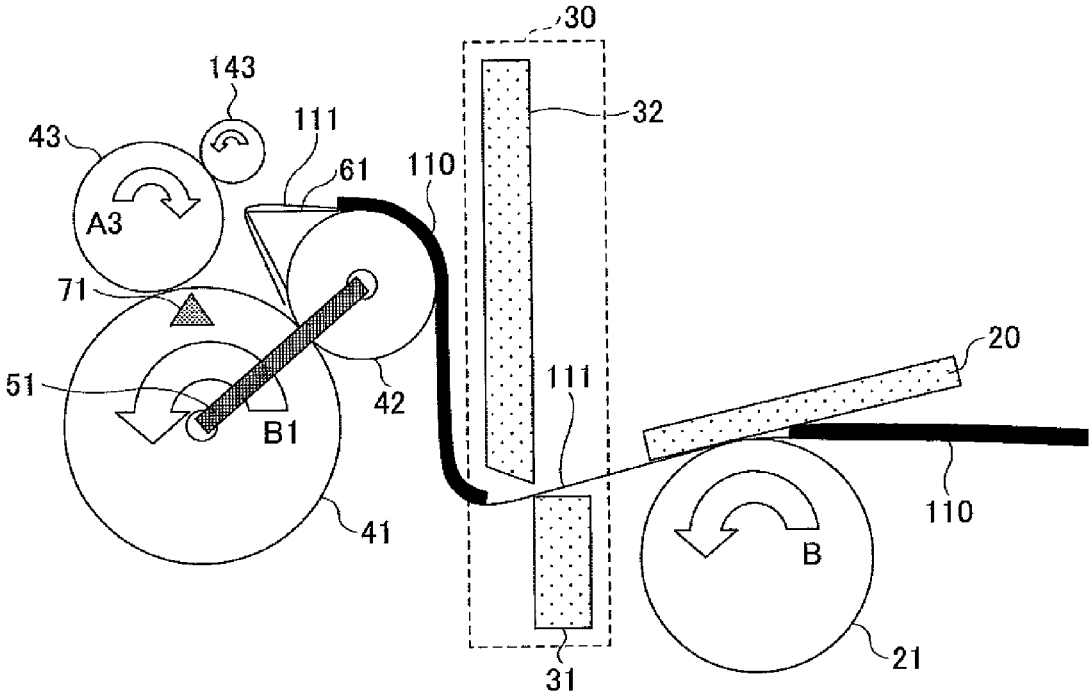
FIG. 8B is a diagram illustrating the method of discharging a label of a printer of the third embodiment.

Next, as illustrated in FIG. 8B, the first roller 41 is rotated counterclockwise as indicated by arrow B1. As a result, the second roller 42, whose center is connected to the center of the first roller 41 by the connecting arm 51, moves counterclockwise on the outer periphery of the first roller 41 with an end portion of the liner 111 to which the label 110 is applied being held between the first roller 41 and the second roller 42. Specifically, the second roller 42 moves to the vicinity of the third roller 43, so that the recording paper guide 61 and the third roller 43 are out of contact.

Figure 8C:
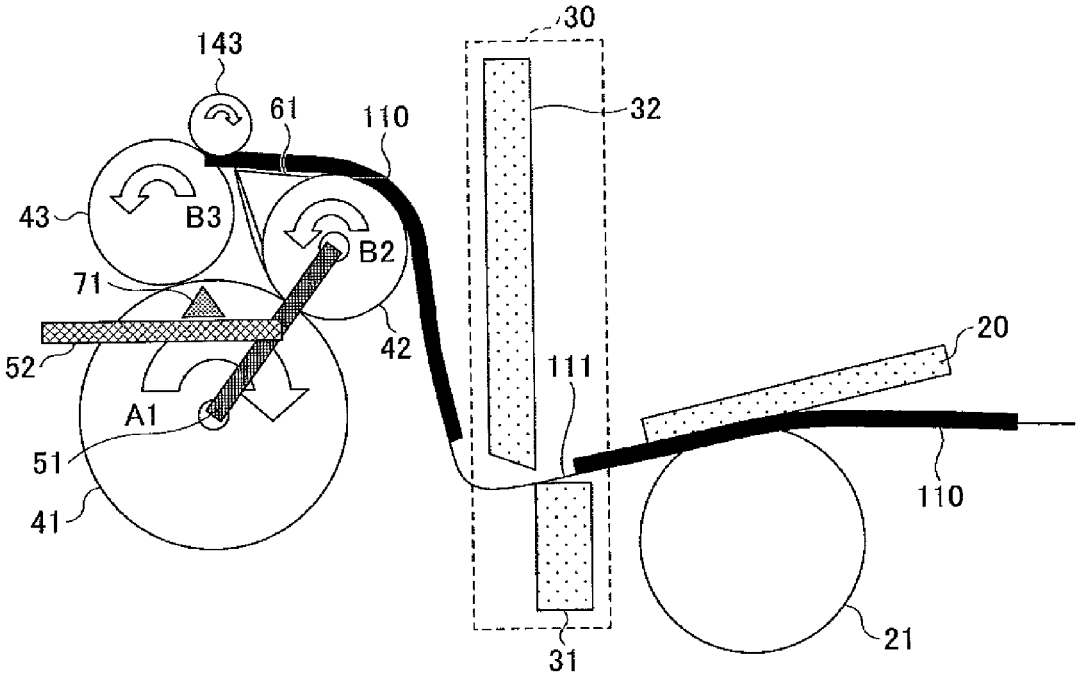
FIG. 8C is a diagram illustrating the method of discharging a label of a printer of the third embodiment.

Next, as illustrated in FIG. 8C, the connecting arm 51 is fixed by the lock part 52, and the first roller 41 is rotated clockwise as indicated by arrow A1. By rotating the first roller 41 clockwise as indicated by arrow A1, the second roller 42 rotates counterclockwise as indicated by arrow B2 and the third roller 43 rotates counterclockwise as indicated by arrow B3. At this point, the label 110 subjected to printing is removed from the liner 111 by the recording paper guide 61, and the label 110 is held between the third roller 43 and the assist roller 143. On the other hand, the liner 111 passes between the second roller 42 and the third roller 43 via the recording paper guide 61 and is thereafter held between the first roller 41 and the second roller 42. Thereafter, the liner 111 to which the label 110 is applied is cut to a predetermined length in the cutter part 30. The assist roller 143 rotates in a direction opposite to the rotation direction of the third roller 43, and in this case, rotates clockwise.

Next, as illustrated in FIG. 80, by further rotating the first roller 41 clockwise as indicated by arrow A1, while removing the label 110 from the liner 111, the label 110 is conveyed with the third roller 43 and the assist roller 143, and the liner 111 is conveyed with the first roller 41 and the second roller 42.

Figure 8D:
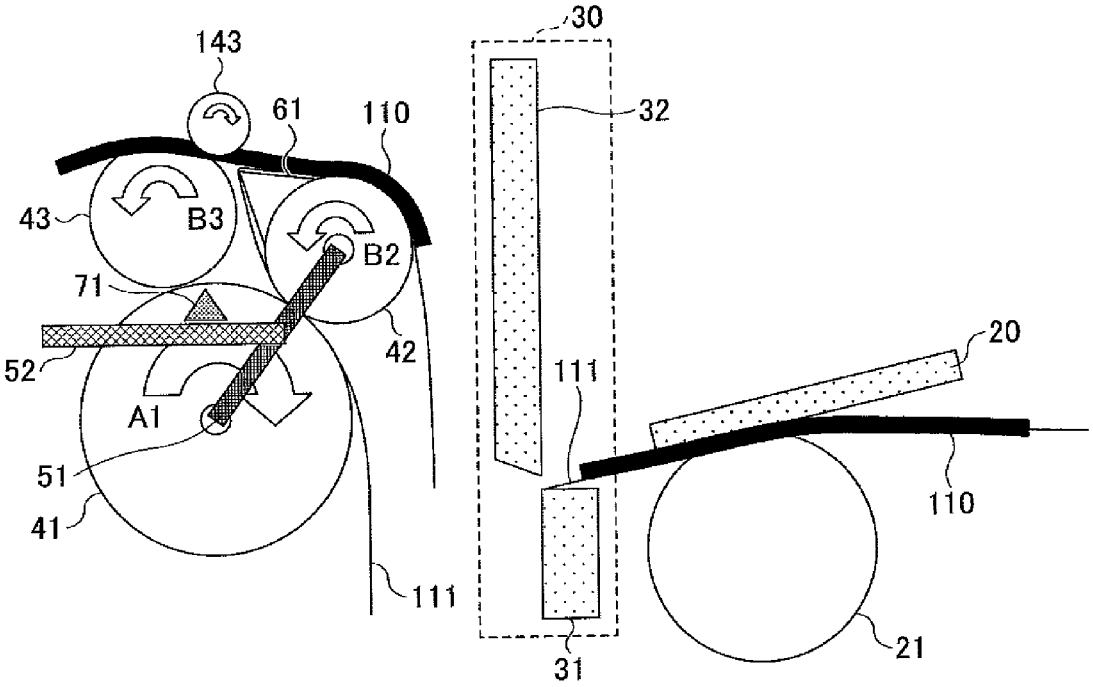
FIG. 8D is a diagram illustrating the method of discharging a label of a printer of the third embodiment.
Figure 8E:
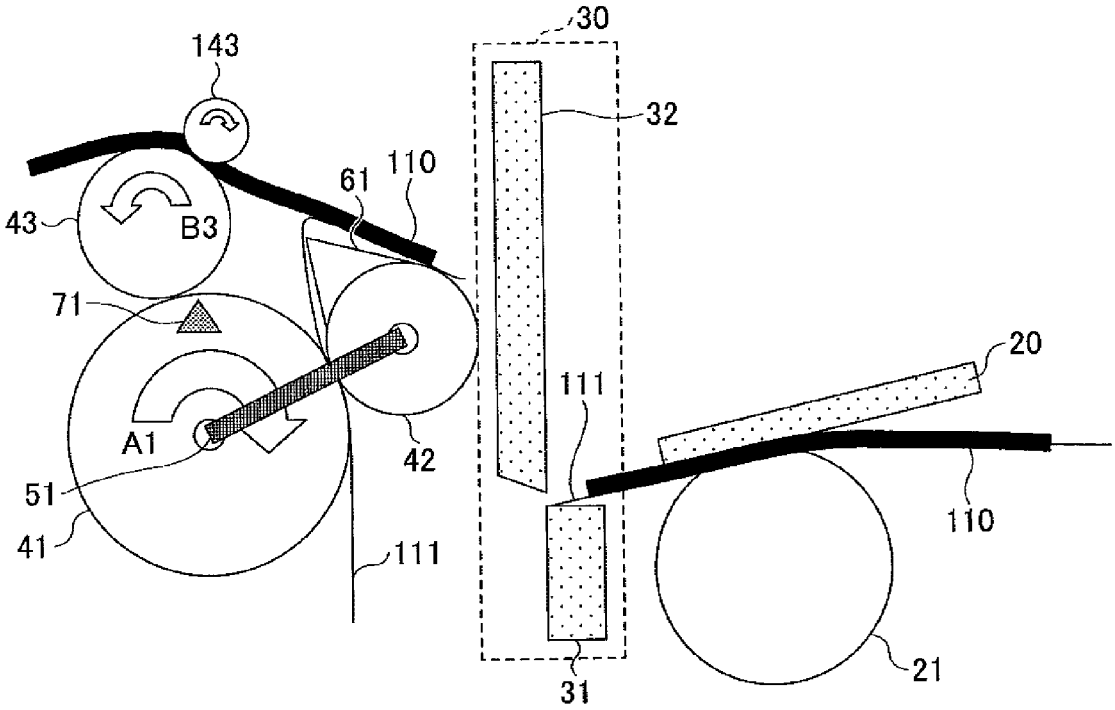
FIG. 8E is a diagram illustrating the method of discharging a label of a printer of the third embodiment.

Next, as illustrated in FIG. 8E, the connecting arm 51 locked by the lock part 52 is released with the first roller 41 being kept rotating clockwise as indicated by arrow A1. As a result, the second roller 42 moves clockwise on the outer periphery of the first roller 41. At this point, the second roller 42 moves while removing the label 110 from the liner 111. The label 110 removed from the liner 111 is conveyed in a direction to discharge the label 111 with the third roller 43 and the assist roller 143.

Figure 8F:
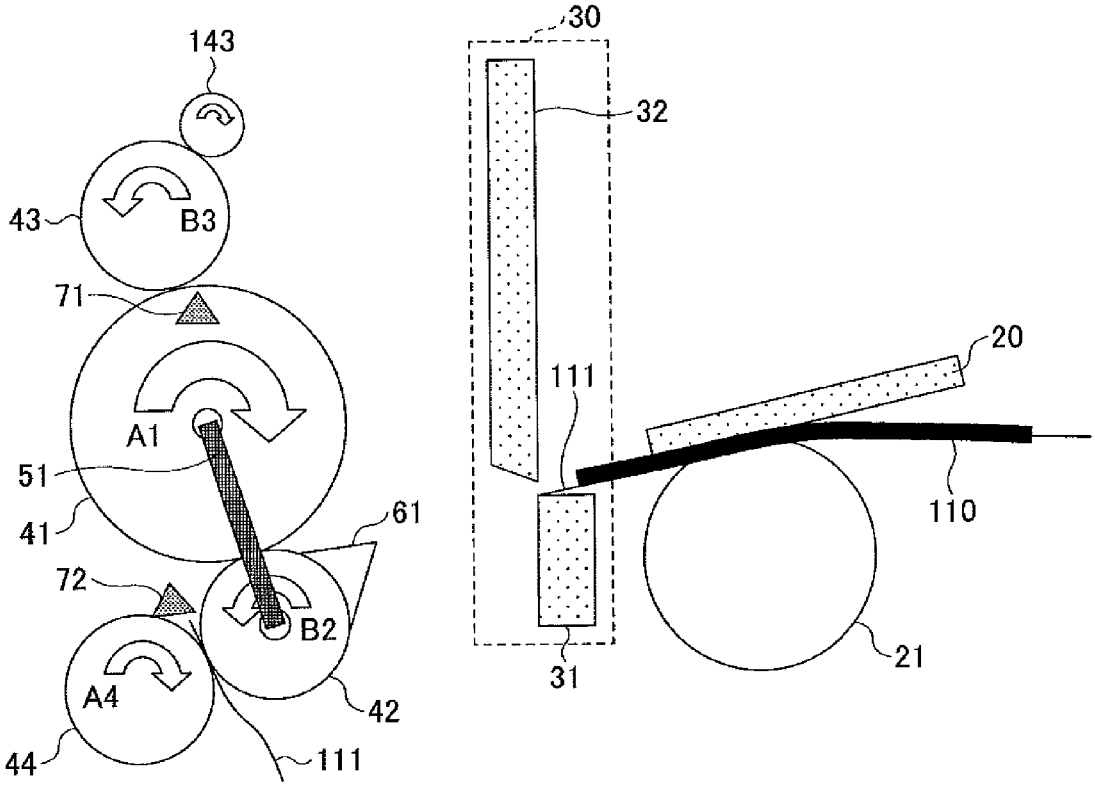
FIG. 8F is a diagram illustrating the method of discharging a label of a printer of the third embodiment.
Figure 8G:
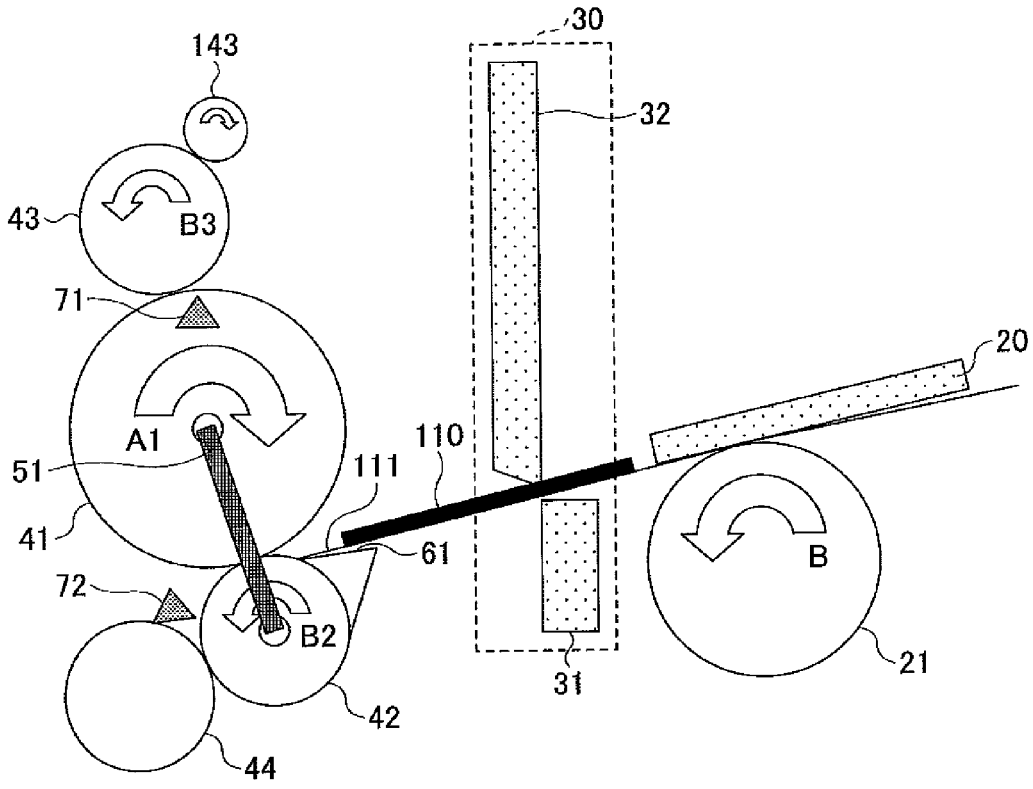
FIG. 8G is a diagram illustrating the method of discharging a label of a printer of the third embodiment.

Next, as illustrated in FIG. 8F, by further rotating the first roller 41 clockwise as indicated by arrow A1, the second roller 42 and the fourth roller 44 are brought into contact. As a result, the liner 111 is held between the second roller 42 and the fourth roller 44. By further rotating the first roller 41 clockwise as indicated by arrow A1 in this state, the second roller 42 rotates counterclockwise as indicated by arrow B2, so that the fourth roller 44, which rotates by contacting the second roller 42, rotates clockwise as indicated by arrow A4. Thus, the liner 111 is conveyed and discharged with the second roller 42 and the fourth roller 44.

Thereafter, as illustrated in FIG. 8G, printing is again performed on the next label 110 by the thermal head 20, and the liner 111 to which the next label 110 is applied is conveyed through the cutter part 30 to the side on which the first roller 41 is provided by the platen roller 21 rotating counterclockwise as indicated by arrow B. Thereafter, like in the above-described case, the liner 111 to which the label 110 is applied is held between the first roller 41 and the second roller 42, and the same operation as the above-described operation is repeated.

In this embodiment, it is possible to remove the label 110 subjected to printing from the liner 111 and feed the label 110 with the first roller 41, the second roller 42, the third roller 43, the fourth roller 44, and the assist roller 143. Therefore, it is possible to reduce the size of a printer capable of perform printing on the label 110.

Furthermore, in the case of combining this embodiment with the first embodiment, the normal recording paper 10 is discharged between the first roller 41 and the third roller 43, and the label 110 is discharged between the third roller 43 and the assist roller 143. Accordingly, it is possible to discharge the recording paper 10 and the label 110 from different positions.

The configuration other than that described above is the same as in the first embodiment.

[Fourth Embodiment]

Next, a fourth embodiment is described. This embodiment relates to a method of controlling a printer of the third embodiment. A printer structure for describing the method of controlling a printer of this embodiment is the same as the structure described in FIG. 5 in the second embodiment. In this embodiment, the fifth roller 45 has the same function as the assist roller 143 of the third embodiment. The operation of the assist roller 143 is described below as the operation of the fifth roller 45.

Figure 9:
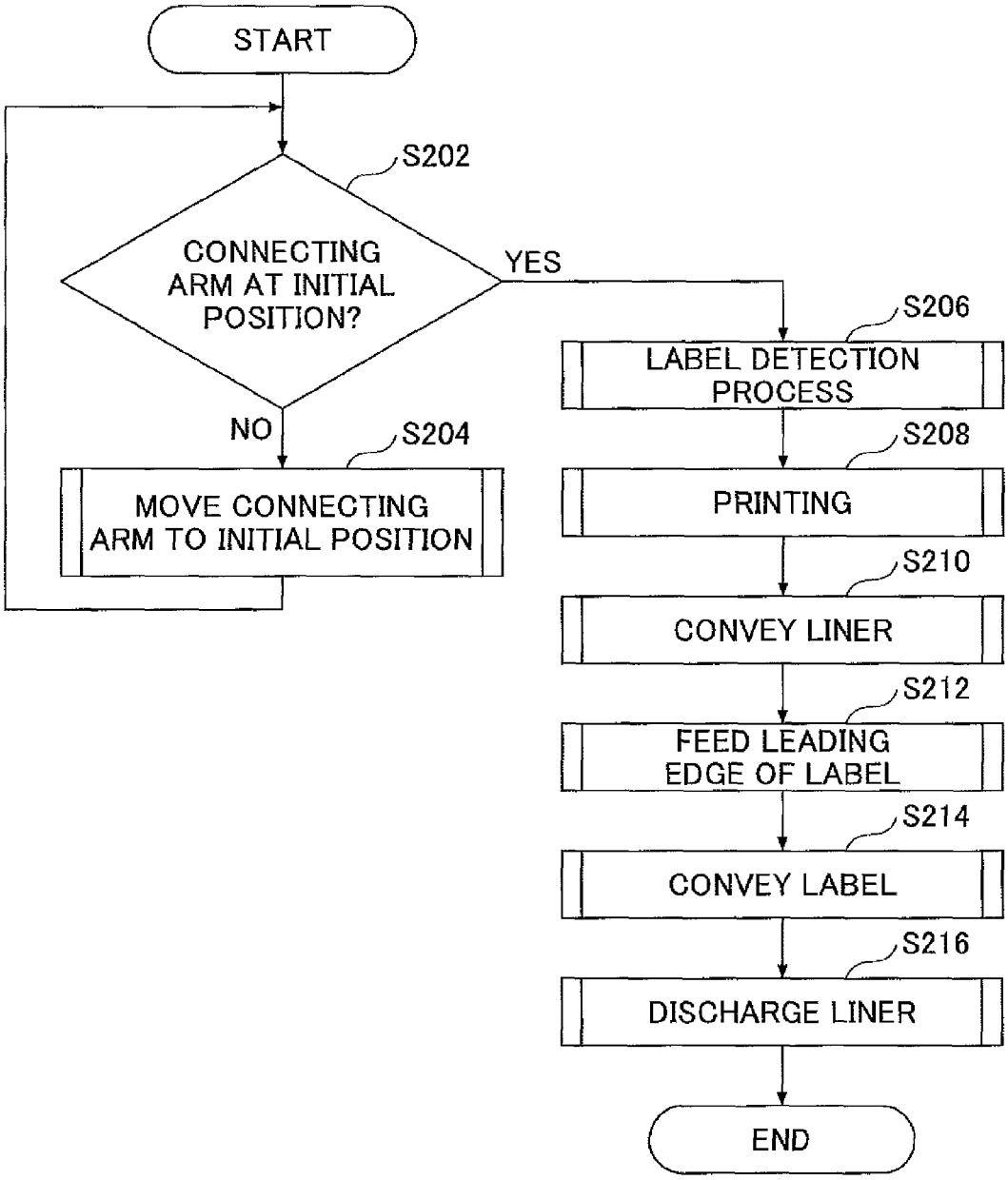
FIG. 9 is a flowchart of a method of controlling a printer of a fourth embodiment.

The method of controlling a printer of this embodiment is described based on FIG. 9.

First, at step S202, it is determined whether the connecting arm 51 is at a predetermined initial position. The connecting arm 51 is referred to as being at a predetermined initial position when, for example, the connecting arm 51 is positioned so as to cause the second roller 42 to be below the first roller 41 as illustrated in FIG. 5. Whether the connecting arm 51 is at an initial position may be determined by whether the eighth sensor S8 detects the connecting arm 51 or not. If the connecting arm 51 is detected by the eighth sensor S8 so that it is determined that the connecting arm 51 is at an initial position (YES at step S202), the process proceeds to step S206. On the other hand, if the connecting arm 51 is not detected by the eighth sensor S8 so that it is determined that the connecting arm 51 is not at an initial position (NO at step S202), the process proceeds to step S204.

Next, at step S204, the connecting arm 51 is moved to the predetermined initial position, that is, a position where the connecting arm 51 is detected by the eighth sensor S8. Specifically, the connecting arm 51 is moved to the predetermined initial position by moving the second roller 42 in contact with the outer periphery of the first roller 41 clockwise by causing the first roller 41 to rotate clockwise. If the connecting arm 51 is not detected by the eighth sensor S8 even after repeating this process several times, an error process is executed.

At step S206, a label detection process is executed. Specifically, the label 110 applied to the liner 111 differs in light reflectance or transmittance between a part of the liner 111 and a part of the label 110. Accordingly, it is possible to detect the position of the liner 111 and a position at which the label 110 is applied on the liner 111 with the first sensor S1 and the second sensor S2.

Next, at step S208, printing is performed on the label 110. At this point, because the platen roller 21 rotates counterclockwise, the liner 111 to which the label 110 is applied is conveyed through the cutter part 30 in a direction in which the first roller 41 is provided.

Next, at step S210, the liner 111 is further conveyed while performing printing on the label 110, and the first roller 41 is rotated clockwise. That is, because the platen roller 21 rotates counterclockwise, the liner 111 to which the label 110 subjected to printing is applied is conveyed and the liner 111 is held between the first roller 41 rotating clockwise and the second roller 42 rotating counterclockwise. Specifically, the liner 111 is held between the first roller 41 and the second roller 42 as illustrated in FIG. 8A.

Next, at step S212, an operation to feed a leading edge of the label 110 is performed. That is, by rotating the first roller 41 counterclockwise, the second roller 42 is moved counterclockwise on the outer periphery of the first roller 41. At this point, the second roller 42 moves on the outer periphery of the first roller 41 with the liner 111 being held between the first roller 41 and the second roller 42. As illustrated in FIG. 7, the second roller 42 moves until the second roller 42 is positioned above the first roller 41, and with this, the connecting arm 51 also moves. Therefore, it is possible to detect the position of the connecting arm 51 in this state with the seventh sensor S7. Specifically, the second roller 42 and the connecting arm 51 are moved as illustrated in FIG. 8B. In this state, by rotating the first roller 41 clockwise, the second roller 42 rotates counterclockwise. Therefore, it is possible to hold the liner 111 between the first roller 41 and the second roller 42.

Next, at step S214, the connecting arm 51 is fixed by the lock part 52, and the first roller 41 is rotated clockwise. As a result, the second roller 42 rotates counterclockwise, and the third roller 43 rotates counterclockwise. Furthermore, the fifth roller 45 in contact with the third roller 43 rotates clockwise. As a result, the label 110 is removed from the liner 111, and the label 110 is conveyed toward the third discharge opening 303 with the third roller 43 and the fifth roller 45. The liner 111 is held between the first roller 41 and the second roller 42 and is conveyed as is with the first roller 41 and the second roller 42. Specifically, the liner 111 is conveyed as illustrated in FIGS. 8C and 8D. The liner 111 is cut to a predetermined length in the cutter part 30.

Next, at step S216, the liner 111 is discharged. Specifically, the connecting arm 51 fixed by the lock part 52 is released with the first roller 41 being kept rotating clockwise. As a result, the second roller 42 moves clockwise on the outer periphery of the first roller 41, and moves to the predetermined initial position illustrated in FIG. 5. Thereafter, by further rotating the first roller 41 clockwise, the liner 111 is discharged by the first roller 41 and the second roller 42. Specifically, the liner 111 is discharged as illustrated in FIGS. 8E and 8F.

Thereby, processing such as printing on a label in a printer of this embodiment ends. The configuration other than that described above is the same as in the second embodiment.

The present invention is not limited to the specifically disclosed embodiments, and variations and modifications may be made without departing from the scope of the present invention. The printers of the above-described embodiments may have the structures illustrated in the drawings turned upside down or may have a structure where the rotation direction is reversed, that is, the clockwise rotation is changed to the counterclockwise rotation and the counterclockwise rotation is changed to the clockwise rotation, with respect to rollers such as the first roller 41.

What is claimed is:

1. A printer, comprising:

a printing part that performs printing on a label adhering to a liner;

a cutter that cuts the liner to which the label adheres;

a first roller provided on a side to which the liner to which the label adheres is discharged from the cutter;

a second roller that is in contact with the first roller and is rotated by a rotation of the first roller;

a third roller that is in contact with the first roller and is rotated by the rotation of the first roller; and a connecting arm that connects a center of the first roller and a center of the second roller, wherein the liner is separated from the label by the first roller and the second roller, and the label separated from the liner is discharged by the third roller.

2. The printer as claimed in claim 1, wherein the second roller connected to the connecting arm is movable on an outer periphery of the first roller by the rotation of the first roller.

3. The printer as claimed in claim 2, wherein when the first roller is rotated in a first rotation direction, the second roller moves in the first rotation direction on the outer periphery of the first roller, and when the first roller is rotated in a second rotation direction opposite to the first rotation direction, the second roller moves in the second rotation direction on the outer periphery of the first roller.

4. The printer as claimed in claim 1, further comprising:

a lock that fixes a position of the connecting arm or the second roller so as to rotate the second roller at a predetermined position.

5. The printer as claimed in claim 1, further comprising:

an assist roller that is in contact with the third roller, wherein the label is conveyed between the third roller and the assist roller.

6. A method of controlling a printer, comprising:

holding a liner to which a label adheres between a first roller and a second roller by rotating the first roller in a first rotation direction and the second roller in a second rotation direction that is opposite to the first rotation direction, wherein the first roller is provided on a side to which the liner is discharged from a cutter that cuts the liner, the second roller is in contact with the first roller and is rotated by a rotation of the first roller, and the second roller is movable on an outer periphery of the first roller by the rotation of the first roller;

moving the second roller in the second rotation direction on the outer periphery of the first roller with the liner to which the label adheres being held between the first roller and the second roller, by rotating the first roller in the second rotation direction;

separating the label from the liner by rotating the second roller in the second rotation direction by rotating the first roller in the first rotating direction with the liner held between the first roller and the second roller;

conveying the label from the second roller to a third roller that is in contact with the first roller and is rotated by the rotation of the first roller; and conveying the label in a direction to discharge the label with the third roller, by rotating the first roller in the first rotation direction.

7. The method of controlling a printer as claimed in claim 6, wherein, in a case of conveying the label, the label is conveyed by fixing the second roller at a predetermined position and causing the second roller to rotate at the predetermined position.

8. The method of controlling a printer as claimed in claim 6, further comprising:

rotating the first roller in the first direction so as to move the second roller in the first rotation direction on the outer periphery of the first roller with the liner being held between the first roller and the second roller.

9. The method of controlling a printer as claimed in claim 6, wherein the printer includes an assist roller that rotates in contact with the third roller, and rotating the first roller in the first direction so as to rotate the third roller in the second direction and the assist roller that is in contact with the third roller in the first rotation direction, so as to convey the label with the third roller and the assist roller.

* * * * *